US008248331B2

(12) United States Patent
Ono

(10) Patent No.: US 8,248,331 B2
(45) **Date of Patent: *Aug. 21, 2012**

(54) IMAGE DISPLAY DEVICE AND METHOD OF CONTROLLING THE SAME

(75) Inventor: Shinya Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/045,905

(22) Filed: Mar. 11, 2011

(65) Prior Publication Data

US 2011/0164024 A1 Jul. 7, 2011

Related U.S. Application Data

(63) Continuation of application No. 12/823,218, filed on Jun. 25, 2010, now Pat. No. 8,018,404, which is a continuation of application No. PCT/JP2009/005181, filed on Oct. 6, 2009.

(30) Foreign Application Priority Data

Oct. 7, 2008 (JP) ..... 2008-261029

(51) Int. Cl.
*G09G 3/30* (2006.01)

(52) U.S. Cl. ..... 345/76; 345/82

(58) Field of Classification Search ..... 345/76–84; 315/169.1, 169.3

See application file for complete search history.

(56) References Cited

U.S. PATENT DOCUMENTS 6,611,107 B2 8/2003 Mikami et al.
7,075,238 B2 7/2006 Lee et al.
7,205,965 B2 4/2007 Mikami et al.
7,329,849 B2 2/2008 Kasai
2003/0103022 A1 6/2003 Noguchi et al.
2003/0111966 A1 6/2003 Mikami et al.
2004/0021620 A1 2/2004 Mikami et al.
2004/0257353 A1 12/2004 Imamura et al.
2005/0243076 A1 11/2005 Kim et al.

(Continued)

FOREIGN PATENT DOCUMENTS

JP 2001-083924 3/2001

(Continued)

OTHER PUBLICATIONS

U.S. Appl. No. 13/082,660 to Shinya Ono, which was filed on Apr. 8, 2011.
U.S. Appl. No. 13/035,132 to Masafumi Matsui et al., which was filed on Feb. 25, 2011.

(Continued)

*Primary Examiner* — Regina Liang
(74) *Attorney, Agent, or Firm* — Greenblum & Bernstein, P.L.C.

(57) ABSTRACT

An image display device includes a driver having a gate connected to a first electrode of a first capacitor and a source connected to an anode of a luminescence element. A second capacitor is connected to a second electrode of the first capacitor. A first switch supplies a reference voltage to the first electrode of the first capacitor. A second switch supplies a signal voltage to the second electrode of the first capacitor. A third switch connects the anode of the luminescence element to the second capacitor. A method of controlling the image display device includes: supplying the signal voltage to the first capacitor by switching ON the first and second switches when the third switch is OFF; switching OFF the first and second switches to turn ON the third switch after the first capacitor holds a capacitor voltage; and causing the second capacitor to hold a source potential of the driver while the third switch is ON.

14 Claims, 16 Drawing Sheets

U.S. PATENT DOCUMENTS

| | | | |
|---|---|---|---|
| 2006/0007070 | A1 | 1/2006 | Shih |
| 2006/0044235 | A1 | 3/2006 | Lee et al. |
| 2006/0066251 | A1 | 3/2006 | Sim |
| 2006/0139260 | A1 | 6/2006 | Shibusawa |
| 2006/0231740 | A1 | 10/2006 | Kasai |
| 2006/0238461 | A1 | 10/2006 | Goh et al. |
| 2007/0296652 | A1 | 12/2007 | Imamura et al. |
| 2010/0149140 | A1 | 6/2010 | Nakamura et al. |
| 2010/0214273 | A1 | 8/2010 | Shirouzu et al. |
| 2010/0259531 | A1 | 10/2010 | Ono |

FOREIGN PATENT DOCUMENTS

| | | |
|---|---|---|
| JP | 2003-186438 | 7/2003 |
| JP | 2003-208127 | 7/2003 |
| JP | 2004-246204 | 9/2004 |
| JP | 2005-4173 | 1/2005 |
| JP | 2005-346073 | 12/2005 |
| JP | 2006-72303 | 3/2006 |
| JP | 2006-301159 | 11/2006 |
| JP | 2008-203655 | 9/2008 |

OTHER PUBLICATIONS

U.S. Appl. No. 13/035,175 to Masafumi Matsui et al., which was filed on Feb. 25, 2011.

U.S. Appl. No. 12/815,887 to Rie Odawara et al., which was filed on Jun. 15, 2010.

U.S. Appl. No. 12/797,150 to Hiroshi Shirouzu et al., which was filed on Jun. 9, 2010.

U.S. Appl. No. 12/823,234 to Rie Odawara et al., which was filed on Jun. 25, 2010.

U.S. Appl. No. 12/855,027 to Kenji Okumoto, which was filed on Aug. 12, 2010.

Search report from E.P.O. in European Pat. Appl. No. 09818966.5, mailed Oct. 15, 2010.

Japan Office Action issued in JP Pat. Appl. No. 2010-513522, mail date is Mar. 8, 2011.

IMAGE DISPLAY DEVICE AND METHOD OF CONTROLLING THE SAME

CROSS REFERENCE TO RELATED APPLICATION

The present application is a continuation application of U.S. patent application Ser. No. 12/823,218, filed Jun. 25, 2010, which is a continuation application of PCT Application No. PCT/JP2009/005181, filed Oct. 6, 2009, designating the United States of America. The disclosure of each of these documents, including the specification, drawings, and claims, is incorporated herein by reference in its entirety.

The disclosure of Japanese Patent Application No. 2008-261029 filed on Oct. 7, 2008, including the specification, drawings, and claims, is incorporated herein by reference in its entirety.

BACKGROUND OF THE INVENTION

1. Field of the Invention

The present invention relates to image display devices and methods of controlling the same, and in particular to an image display device using a current-driven luminescence element and a method of controlling the same.

2. Description of the Related Art

Image display devices in which organic electro-luminescence (EL) elements are used are known as image display devices with which current-driven luminescence elements are used. The organic EL display devices using organic EL elements which emit light are best suited to make thinner devices because such organic EL elements eliminate the necessity of back lights conventionally required for liquid crystal display devices. In addition, the organic EL elements do not place a limit on view angle, and thus are expected to be practically used as next-generation display devices. Further, the organic EL elements used for the organic EL display devices including luminance elements whose luminance are controlled by currents having certain values, instead of including liquid crystal cells controlled by voltages to be applied thereto.

In a usual organic EL display device, organic EL elements which serve as pixels are arranged in a matrix. An organic EL display is called a passive-matrix organic EL display, in which organic electro-luminescence elements are provided at intersections of row electrodes (scanning lines) and column electrodes (data lines) and voltages corresponding to data signals are applied to between selected row electrodes and the column electrodes to drive the organic EL elements.

On the other hand, an organic EL display device is called an active-matrix organic EL display, in which switching thin film transistors (TFTs) are provided at the intersections of scanning lines and data lines and connected with the gates of driving transistors which receive data signals, through the signal lines, when the TFTs are turned on through selected scanning lines, and causes the driving transistors to activate the organic EL elements.

Although the passive-matrix organic EL display device in which organic EL elements connected to selected row electrodes (scanning lines) emit light only until the selected row electrodes become unselected, organic EL elements in the active-matrix organic EL display device keep emitting light until they are scanned (or selected). Thus, there is no reduction in luminance even when the number of scanning lines increases. Accordingly, the active-matrix organic EL display device is driven with a low voltage, thereby consuming less power.

Patent Reference (Japanese Unexamined Patent Application Publication No. 2005-4173) discloses a circuit configuration of pixel units in an active-matrix organic EL display device.

FIG. 16 is a diagram showing a circuit configuration of a pixel unit in a conventional organic EL display device disclosed in Patent Reference. The pixel unit 500 is configured with a simple circuitry including: an organic EL element 505 having a cathode connected to a negative power source line (whose voltage value is denoted as VEE); an n-type thin film transistor (n-type TFT) 504 having a drain connected to a positive power source line (whose voltage value is denoted as VDD) and a source connected to the anode of the organic EL element 505; a capacitor element 503 which is connected to between the gate and source of the n-type TFT 504 and holds a gate voltage of the n-type TFT 504; a third switching element 509 for causing both the terminals of the organic EL element 505 to have approximately the same potential; a first switching element 501 which selectively applies a video signal from a signal line 506 to the gate of the n-type TFT 504; and a second switching element 502 for initializing the gate potential of the n-type TFT 504 into a predetermined potential. The following describes light emitting operations performed by the pixel unit 500.

First, the second switching element 502 is brought into an on state by a scanning signal supplied from the second scanning line 508. A predetermined voltage VREF supplied from a reference power source line is applied to the gate of the n-type TFT 504 so as to prevent a current from flowing into between the source and drain of the n-type TFT 504 in order to initialize the n-type TFT 504.

Next, the second switching element 502 is brought into an off state by a scanning signal supplied from the second scanning line 508 (S102).

Next, the first switching element 501 is brought into an on state by a scanning signal supplied from the first scanning line 507 to apply a signal voltage supplied from the signal line 506 to the gate of the n-type TFT 504 (S103). At this time, the gate of the third switching element 509 is connected to the first scanning line 507, and thus becomes conductive simultaneously with the first switching element 501. This makes it possible to accumulate charge corresponding to a signal voltage in the capacitor element 503 without being affected by the voltage between the terminals of the organic EL element 505. In addition, the organic EL element 505 is not supplied with a current while the third switching element 509 is conductive, and thus does not emit light.

Next, the third switching element 509 is brought into an off state by a scanning signal supplied from the first scanning line 507 to supply a signal current corresponding to the charge accumulated in the capacitor element 503 from the n-type TFT 504 to the organic EL element 505 (S104). At this time, the organic EL element 505 emits light.

The sequential operations described above enable the organic EL element 505 to emit light with a luminance corresponding to the signal voltage supplied from the signal line in a frame period.

SUMMARY OF THE INVENTION

However, the conventional organic EL display device disclosed in Patent Reference allows a current to flow into the negative power source line through the third switching element 509 because the n-type TFT 504 is brought into an on state when the signal voltage is stored on the gate of the n-type TFT 504 (Step S103). This current flows into the resistance components of the third switching element 509 and the negative power source line, resulting in variation in the potential of the source of the n-type TFT 504. In other words, the voltage which should be held by the capacitor element 503 inevitably varies.

As described above, in the case of configuring a pixel circuitry which performs a source grounding operation in form of the n-type TFT such as an amorphous Si, it is difficult to store an exact potential between both the end electrodes of the capacitor element having a function of holding a voltage between the gate and source of the n-type driving TFT. In this case, since no exact signal current corresponding to the signal voltage flows, the luminescence elements do not emit light properly. This disables achievement of highly accurate image display reflecting the video signal.

In view of the above described problems, the present invention has an object to provide, in form of a simple pixel circuitry, an image display device which includes luminescence pixels and is capable of storing an exact potential corresponding to a signal voltage to both the end electrodes of the electrostatic capacitor which holds a voltage between the gate and source of the n-type driving TFT.

In order to achieve the aforementioned object, an image display device according to an aspect of the present invention includes: a luminescence element; a first capacitor which holds a voltage; a driving element which has a gate electrode connected to a first electrode of the first capacitor and a source electrode connected to a first electrode of the luminescence element, and causes the luminescence element to emit light by applying a drain current corresponding to the voltage held by the first capacitor to the luminescence element; a second capacitor having a first electrode connected to a second electrode of the first capacitor; a first power source line for determining a potential of the drain electrode of the driving element; a second power source line electrically connected to the second electrode of the luminescence element; a third power source line for supplying a first reference voltage defining a voltage value of a first electrode of the first capacitor; a fourth power source line for supplying a second reference voltage defining a voltage value of a second electrode of the second capacitor; a first switching element for setting the first reference voltage for the first electrode of the first capacitor; a data line for supplying a signal voltage to the second electrode of the first capacitor; a second switching element which has a first terminal electrically connected to the data line and a second terminal electrically connected to the second electrode of the first capacitor, and switches between conductive and non-conductive states between the data line and the second electrode of the first capacitor; a third switching element for connecting the first electrode of the luminescence element and the second electrode of the first capacitor; and a driving circuit for controlling the first switching element, the second switching element, and the third switching element, wherein the driving circuit: causes the first capacitor to hold the voltage corresponding to the signal voltage by turning on the first switching element and the second switching element while the third switching element is turned off; turns off the first switching element and the second switching element to turn on the third switching element after the voltage corresponding to the signal voltage is held by the first capacitor, and causes the second capacitor to hold a source potential of the driving element while the third switching element is turned on.

According to an image display device and a method of controlling the same in the present invention, only currents flowing through luminescence elements flow into an n-type driving TFT without passing through reference power source lines and signal lines. This makes it possible to store an exact potential on both the end electrodes of the capacitor element having a function of holding the voltage between the gate and source of the n-type driving TFT, thereby achieving a highly accurate image display reflecting a video signal.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the Drawings.

DESCRIPTION OF THE PREFERRED EMBODIMENTS

Figure 1:
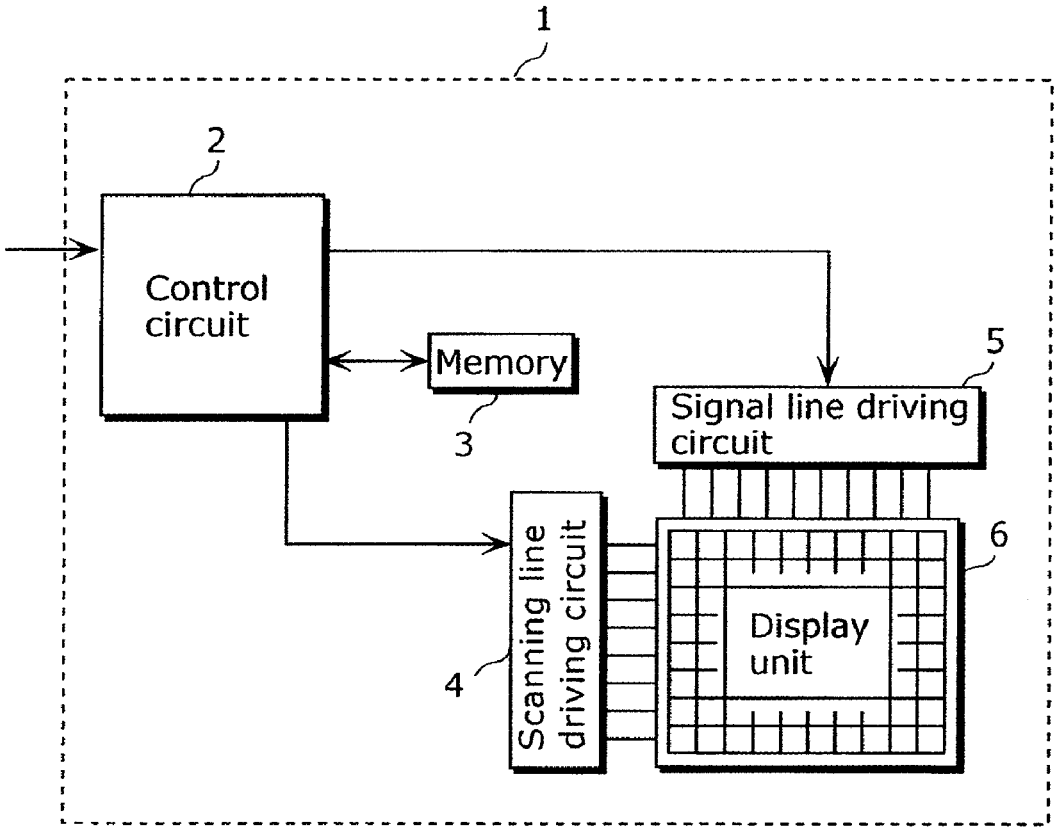
FIG. 1 is a block diagram showing an electrical configuration of an image display device according to an embodiment of the present invention.

An image display device according to an aspect of the present invention includes: a luminescence element; a first capacitor which holds a voltage; a driving element which has a gate electrode connected to a first electrode of the first capacitor and a source electrode connected to a first electrode of the luminescence element, and causes the luminescence element to emit light by applying a drain current corresponding to the voltage held by the first capacitor to the luminescence element; a second capacitor having a first electrode connected to a second electrode of the first capacitor; a first power source line for determining a potential of the drain electrode of the driving element; a second power source line electrically connected to the second electrode of the luminescence element; a third power source line for supplying a first reference voltage defining a voltage value of a first electrode of the first capacitor; a fourth power source line for supplying a second reference voltage defining a voltage value of a second electrode of the second capacitor; a first switching element for setting the first reference voltage for the first electrode of the first capacitor; a data line for supplying a signal voltage to the second electrode of the first capacitor; a second switching element which has a first terminal electrically connected to the data line and a second terminal electrically connected to the second electrode of the first capacitor, and switches between conductive and non-conductive states between the data line and the second electrode of the first capacitor; a third switching element for connecting the first electrode of the luminescence element and the second electrode of the first capacitor; and a driving circuit for controlling the first switching element, the second switching element, and the third switching element, wherein the driving circuit: causes the first capacitor to hold the voltage corresponding to the signal voltage by turning on the first switching element and the second switching element while the third switching element is turned off; turns off the first switching element and the second switching element to turn on the third switching element after the voltage corresponding to the signal voltage is held by the first capacitor, and causes the second capacitor to hold a source potential of the driving element while the third switching element is turned on.

This implementation is intended to (i) provide the third switching element to connect the first electrode of the luminescence element and a node between the second electrode of the capacitor and the second switching element, (ii) cause the capacitor to hold the voltage corresponding to the signal voltage while the third switching element is turned off, and (iii) turn on the third switching element after the voltage corresponding to the signal voltage is held by the capacitor. With this, it is possible to set, for the capacitor, the voltage corresponding to the signal voltage in a state where the source electrode of the driving element and the second electrode of the capacitor are disconnected. In other words, it is possible to prevent a current from flowing from the source electrode of the driving transistor into the capacitor before the storage of the voltage corresponding to the signal voltage into the capacitor is completed. For this, since the voltage exactly corresponding to the signal voltage can be held by the capacitor, it is possible to prevent variation in the voltage held by the capacitor, thereby preventing the luminescence elements from not emitting light in the exact amount reflecting the video signal. As a result, it is possible to cause the luminescence elements to emit light in the exact amount reflecting the video signal, thereby achieving a highly accurate image display reflecting the video signal.

According to this implementation, it is also good to provide the second capacitor between the second electrode of the capacitor and the fourth power source line so as to cause the second capacitor to store the source potential of the driving element while the third switching element is turned on. With this, the potential of the second electrode of the capacitor is fixed even in the case of causing the second capacitor to store the source potential of the driving element in a steady state and then turning off the third switching element, thereby fixing the gate voltage of the driving element. In addition, since the source potential of the driving element is in a steady state, the second capacitor stabilizes the voltage between the gate and source of the driving element.

In the image display device according to the aspect of the present invention, the first electrode of the luminescence element may be an anode electrode, and the second electrode of the luminescence element may be a cathode electrode, and a voltage of the first power source line may be higher than a voltage of the second power source line, and a current may flow from the first power source line to the second power source line.

According to this implementation, the driving element is configured in form of an N-type transistor.

The image display device according to the aspect of the present invention may include: a first scanning line for connecting the first switching element and the driving circuit, and transmitting a signal for controlling the first switching element to the first switching element; a second scanning line for connecting the second switching element and the driving circuit, and transmitting a signal for controlling the second switching element to the second switching element; and a third scanning line for connecting the third switching element and the driving circuit, and transmitting a signal for controlling the third switching element to the third switching element.

According to this implementation, it is also good to provide (i) a first scanning line for connecting the first switching element and the driving circuit so as to enable the driving circuit to control the first switching element, (ii) a second scanning line for connecting the second switching element and the driving circuit so as to enable the driving circuit to control the second switching element, and (iii) a third scanning line for connecting the third switching element and the driving circuit so as to enable the driving circuit to control the third switching element.

In the image display device according to the aspect of the present invention, the first scanning line and the second scanning line may be provided as a common scanning line.

According to this implementation, it is also good that the first scanning line and the second scanning line are provided as a common scanning line. In this case, it is possible to reduce the number of scanning lines for controlling switching elements, thereby simplifying the circuit configuration.

In the image display device according to the aspect of the present invention, the third power source line and the fourth power source line may be provided as a common scanning line.

According to this implementation, it is also good that the third power source line and the fourth power source line are provided as a common power source line.

In the image display device according to the aspect of the present invention, the third power source line and the fourth power source line may be provided as separate scanning lines.

According to this implementation, it is also good that the third power source line and the fourth power source line are provided as separate common power source lines. In this case, the voltages of the capacitor and the second capacitor are independently adjusted, thereby increasing the flexibility in the circuit adjustments.

In addition, an image display device according to an aspect of the present invention includes: a luminescence element; a first capacitor which holds a voltage; a driving element which has a gate electrode connected to a first electrode of the first capacitor and a source electrode connected to a first electrode of the luminescence element, and causes the luminescence element to emit light by applying a drain current corresponding to the voltage held by the first capacitor to the luminescence element; a second capacitor having a first electrode connected to a second electrode of the first capacitor; a first power source line for determining a potential of the drain electrode of the driving element; a second power source line electrically connected to the second electrode of the luminescence element; a third power source line for supplying a second reference voltage defining a voltage value of a second electrode of the first capacitor; a fourth power source line for supplying a second reference voltage defining a voltage value of a second electrode of the second capacitor; a first switching element for setting the second reference voltage for the second electrode of the first capacitor; a data line for supplying a signal voltage to the first electrode of the first capacitor; a second switching element which has a first terminal electrically connected to the data line and a second terminal electrically connected to the first electrode of the first capacitor, and switches between conductive and non-conductive states between the data line and the first electrode of the first capacitor; a third switching element for connecting the first electrode of the luminescence element and the second electrode of the first capacitor; and a driving circuit for controlling the first switching element, the second switching element, and the third switching element, wherein the driving circuit: causes the first capacitor to hold the voltage corresponding to the signal voltage by turning on the first switching element and the second switching element while the third switching element is turned off; turns off the first switching element and the second switching element to turn on the third switching element after the voltage corresponding to the signal voltage is held by the first capacitor, and causes the second capacitor to hold a source potential of the driving element while the third switching element is turned on.

In this implementation, (i) the third switching element is provided to connect the first electrode of the luminescence element and a node between the second electrode of the capacitor and the first switching element, (ii) the capacitor is configured to hold the voltage corresponding to the signal voltage while the third switching element is turned off, and (iii) the third switching element is turned on after the voltage corresponding to the signal voltage is held by the capacitor. With this, it is possible to set, for the capacitor, the voltage in a state where the source electrode of the driving element and the second electrode of the capacitor are disconnected. In other words, it is possible to prevent a current from flowing from the source electrode of the driving transistor into the capacitor before the storage of the voltage corresponding to the signal voltage into the capacitor is completed. For this, since the voltage exactly corresponding to the signal voltage can be held by the capacitor, it is possible to prevent variation in the voltage held by the capacitor, thereby enabling the luminescence elements from emitting light in the exact amount reflecting the video signal. As a result, it is possible to cause the luminescence elements to emit light in the exact amount reflecting the video signal, thereby achieving a highly accurate image display reflecting the video signal.

According to this implementation, it is also good to provide the second capacitor between the second electrode of the capacitor and the fourth power source line so as to cause the second capacitor to store the source potential of the driving element while the third switching element is turned on. With this, the potential of the second electrode of the capacitor is fixed even in the case of causing the second capacitor to store the source potential of the driving element in a steady state and then turning off the third switching element, thereby fixing the gate voltage of the driving element. In addition, since the source potential of the driving element is in a steady state, the second capacitor stabilizes the voltage between the gate and source of the driving element.

In the image display device according to the aspect of the present invention, the first electrode of the luminescence element may be an anode electrode, and the second electrode of the luminescence element may be a cathode electrode, and a voltage of the first power source line may be higher than a voltage of the second power source line, and a current may flow from the first power source line to the second power source line.

According to this implementation, the driving element is configured in form of an N-type transistor.

The image display device according to the aspect of the present invention may include: a first scanning line for connecting the first switching element and the driving circuit, and transmitting a signal for controlling the first switching element to the first switching element; a second scanning line for connecting the second switching element and the driving circuit, and transmitting a signal for controlling the second switching element to the second switching element; and a third scanning line for connecting the third switching element and the driving circuit, and transmitting a signal for controlling the third switching element to the third switching element.

According to this implementation, it is also good to provide (i) a first scanning line for connecting the first switching element and the driving circuit so as to enable the driving circuit to control the first switching element, (ii) a second scanning line for connecting the second switching element and the driving circuit so as to enable the driving circuit to control the first switching element, and (iii) a third scanning line for connecting the third switching element and the driving circuit so as to enable the driving circuit to control the first switching element.

In the image display device according to the aspect of the present invention, the first scanning line and the second scanning line may be provided as a common scanning line.

According to this implementation, it is also good that the first scanning line and the second scanning line are provided as a common scanning line. In this case, it is possible to reduce the number of scanning lines for controlling switching elements, thereby simplifying the circuit configuration.

In the image display device according to the aspect of the present invention, the third power source line and the fourth power source line may be provided as a common scanning line.

According to this implementation, it is also good that the third power source line and the fourth power source line are provided as a common power source line.

In the image display device according to the aspect of the present invention, the third power source line and the fourth power source line may be provided as separate scanning lines.

According to this implementation, it is also good that the third power source line and the fourth power source line are provided as separate common power source lines. In this case, the voltages of the capacitor and the second capacitor are independently adjusted, thereby increasing the flexibility in the circuit adjustments.

In addition, the image display device according to an aspect of the present invention includes pixel units including a first pixel unit and a second pixel unit which are adjacent to each other and each of the first and second pixel units includes: a luminescence element; a first capacitor which holds a voltage; a driving element which has a gate electrode connected to a first electrode of the first capacitor and a source electrode connected to a first electrode of the luminescence element, and causes the luminescence element to emit light by applying a drain current corresponding to the voltage held by the first capacitor to the luminescence element; a second capacitor having a first electrode connected to a second electrode of the first capacitor; a first power source line for determining a potential of the drain electrode of the driving element; a second power source line electrically connected to the second electrode of the luminescence element; a third power source line for supplying a first reference voltage defining a voltage value of a first electrode of the first capacitor; a fourth power source line for supplying a second reference voltage defining a voltage value of a second electrode of the second capacitor; a first switching element for setting the first reference voltage for the first electrode of the first capacitor; a data line for supplying a signal voltage to the second electrode of the first capacitor; a second switching element which has a first terminal electrically connected to the data line and a second terminal electrically connected to the second electrode of the first capacitor, and switches between conductive and non-conductive states between the data line and the second electrode of the first capacitor; a third switching element for connecting the first electrode of the luminescence element and the second electrode of the first capacitor, a first scanning line for communicating a signal for controlling the first switching element to the first switching element; a second scanning line for communicating a signal for controlling the second switching element to the second switching element; and a third scanning line for communicating a signal for controlling the third switching element to the third switching element, wherein the image display device includes a driving circuit which is connected to (i) the first switching element through the first scanning line, (ii) the second switching element through the second scanning line, and (iii) the third switching element through the third scanning line, and which includes a driving circuit for controlling the first switching element, the second switching element, and the third switching element, and wherein the driving circuit: causes the first capacitor to hold the voltage corresponding to the signal voltage by turning on the first switching element and the second switching element while the third switching element is turned off; turns off the first switching element and the second switching element to turn on the third switching element after the voltage corresponding to the signal voltage is held by the first capacitor, causes the second capacitor to hold a source potential of the driving element while the third switching element is turned on, and the first scanning line included in the first pixel unit, the second scanning line included in the first pixel unit, and the third scanning line included in the second pixel unit are diverted from a common scanning line from the driving circuit.

According to this implementation, it is possible to reduce the number of scanning lines for controlling switching elements by causing adjacent pixel units to share a common scanning line, thereby simplifying the circuit configuration as an image display device and simplifying the driving circuit for controlling the switching elements through the scanning line.

In addition, in the image display device according to the aspect of the present invention, the luminescence element may be an organic electro-luminescence (EL) element.

According to this implementation, it is also good that the luminescence elements are organic EL luminescence elements.

In addition, a method according to an aspect of the present invention is intended to control an image display device including: a luminescence element; a first capacitor which holds a voltage; a driving element which has a gate electrode connected to a first electrode of the first capacitor and a source electrode connected to a first electrode of the luminescence element, and causes the luminescence element to emit light by applying a drain current corresponding to the voltage held by the first capacitor to the luminescence element; a second capacitor having a first electrode connected to a second electrode of the first capacitor; a first power source line for determining a potential of the drain electrode of the driving element; a second power source line electrically connected to the second electrode of the luminescence element; a third power source line for supplying a first reference voltage defining a voltage value of a first electrode of the first capacitor; a fourth power source line for supplying a second reference voltage defining a voltage value of a second electrode of the second capacitor; a first switching element for setting the first reference voltage for the first electrode of the first capacitor; a data line for supplying a signal voltage to the second electrode of the first capacitor; a second switching element which has a first terminal electrically connected to the data line and a second terminal electrically connected to the second electrode of the first capacitor, and switches between conductive and non-conductive states between the data line and the second electrode of the first capacitor; and a third switching element for connecting the first electrode of the luminescence element and the second electrode of the first capacitor, wherein the method includes: causing the first capacitor to hold the voltage corresponding to the signal voltage by turning on the first switching element and the second switching element while the third switching element is turned off; turning off the first switching element and the second switching element to turn on the third switching element after the voltage corresponding to the signal voltage is held by the first capacitor, and causing the second capacitor to hold a source potential of the driving element while the third switching element is turned on.

In addition, a method according to an aspect of the present invention is intended to control an image display device including: a luminescence element; a first capacitor which holds a voltage; a driving element which has a gate electrode connected to a first electrode of the first capacitor and a source electrode connected to a first electrode of the luminescence element, and causes the luminescence element to emit light by applying a drain current corresponding to the voltage held by the first capacitor to the luminescence element; a second capacitor having a first electrode connected to a second electrode of the first capacitor; a first power source line for determining a potential of the drain electrode of the driving element; a second power source line electrically connected to the second electrode of the luminescence element; a third power source line for supplying a first reference voltage defining a voltage value of a first electrode of the first capacitor; a fourth power source line for supplying a second reference voltage defining a voltage value of a second electrode of the second capacitor; a first switching element for setting the second reference voltage for the second electrode of the second capacitor; a data line for supplying a signal voltage to the first electrode of the first capacitor; a second switching element which has a first terminal electrically connected to the data line and a second terminal electrically connected to the first electrode of the first capacitor, and switches between conductive and non-conductive states between the data line and the first electrode of the first capacitor; and a third switching element for connecting the first electrode of the luminescence element and the second electrode of the first capacitor, wherein the method includes: causing the first capacitor to hold the voltage corresponding to the signal voltage by turning on the first switching element and the second switching element while the third switching element is turned off; turning off the first switching element and the second switching element to turn on the third switching element after the voltage corresponding to the signal voltage is held by the first capacitor, and causing the second capacitor to hold a source potential of the driving element while the third switching element is turned on.

Preferred embodiments of the present invention will be described below with reference to the drawings. In the following descriptions, the same or equivalent elements are assigned with the same reference numerals throughout the drawings, and the same descriptions are not repeated.

Embodiment 1

An image display device in this embodiment includes luminescence pixels arranged in a matrix. Each of the luminescence pixels includes: a luminescence element; a capacitor; a driving element having a gate connected to a first electrode of the capacitor and having a source connected to the luminescence element; a third switching element for switching between conductive and non-conductive states between the source of the driving element and the second electrode of the capacitor; a first switching element for switching between conductive and non-conductive states between a reference power source line and a first electrode of the capacitor; and a second switching element for switching between conductive and non-conductive states between a data line and a second electrode of the capacitor. This configuration enables storage of an accurate potential corresponding to a signal voltage onto both end terminals of the capacitor. This makes it possible to achieve an accurate image display reflecting a video signal.

Embodiments of the present invention will be described below with reference to the drawings.

FIG. 1 is a block diagram showing an electrical configuration of an image display device according to the present invention. The image display device 1 in the diagram includes a control circuit 2, a memory 3, a scanning line driving circuit 4, a signal line driving circuit 5, and a display unit 6.

Figure 2:
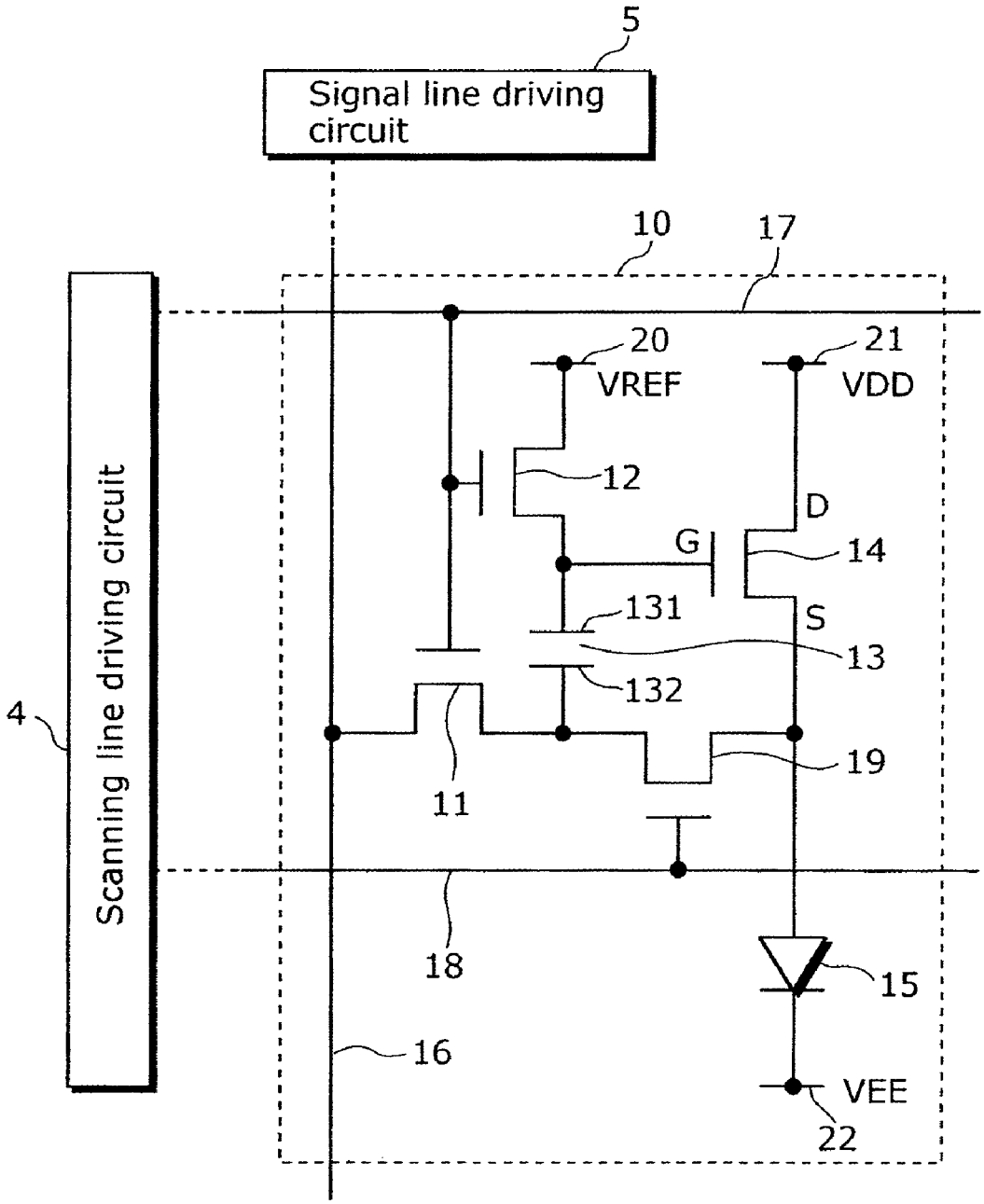
FIG. 2 is a diagram showing a circuit configuration of a luminescence pixel included in a display unit and connections with the surrounding circuits according to Embodiment 1 of the present invention.

In addition, FIG. 2 is a diagram showing a circuit configuration of a luminescence pixel included in a display unit and connections with the surrounding circuits according to Embodiment 1 of the present invention. The luminescence pixel 10 includes switching transistors 11, 12, and 19, an electrostatic capacitor 13, a driving transistor 14, an organic EL element 15, a signal line 16, scanning lines 17 and 18, a reference power source line 20, a positive power source line 21, and a negative power source line 22. In addition, the surrounding circuits include a scanning line driving circuit 4 and a signal line driving circuit 5.

The following descriptions are given of connection relationships and functions of the structural elements shown in FIGS. 1 and 2.

The control circuit 2 has a function of controlling the scanning line driving circuit 4, the signal line driving circuit 5, and the memory 3. The memory 3 stores correction data or the like of the respective luminescence pixels. Based on the correction data written in the memory 3 and read out therefrom, a video signal inputted from outside is corrected and then outputted to the signal line driving circuit 5.

The scanning line driving circuit 4 is connected to the scanning lines 17 and 18, and functions as a driving circuit for controlling between conductive and non-conductive states of the switching transistors 11, 12, and 19 included in the luminescence pixel 10 by outputting a scanning signal to the scanning lines 17 and 18.

The signal line driving circuit 5 is connected to the signal line 16, and functions as a driving circuit for outputting a signal voltage based on a video signal to the luminescence pixel 10.

The display unit 6 includes luminescence pixels 10, and displays an image, based on the video signal inputted from outside to the image display device 1.

The switching transistor 11, as the second switching element, has a gate connected to the scanning line 17 that is the second scanning line, and has a source and drain one of which is connected to the signal line 16 that is the data line and the other of which is connected to an electrode 132 that is the second electrode of the electrostatic capacitor 13. The switching transistor 11 has a function of determining a timing with which the signal voltage of the signal line 16 is applied to the electrode 132 of the electrostatic capacitor 13.

The switching transistor 12, as the first switching element, has a gate connected to the scanning line 17 that is the first scanning line, and has a source and drain one of which is connected to the reference power source line 20 that is the first reference power source line and the other of which is connected to an electrode 131 that is the first electrode of the electrostatic capacitor 13. The switching transistor 12 has a function of determining a timing with which the reference voltage VREF of the reference power source line 20 is applied to the electrode 131 of the electrostatic capacitor 13. The switching transistors 11 and 12 are configured in form of n-type thin film transistors (n-type TFTs).

It is to be noted that the first scanning line and the second scanning line are provided as a common scanning line 17, thereby reducing the number of scanning lines for controlling the switching transistors and simplifying the circuit configuration.

The electrostatic capacitor 13 is a capacitor having the electrode 131 that is the first electrode connected to the gate of the driving transistor 14, and having the electrode 132 that is the second electrode connected to the source of the driving transistor 14 through the switching transistor 19. The electrostatic capacitor 13 holds the voltage corresponding to the signal voltage supplied from the signal line 16. In the case where the switching transistors 11 and 12 are brought into an off state, the electrostatic capacitor 13 exerts the function of causing the driving transistor 14 to hold a constant potential between its gate and source electrodes, and thereby stabilizing a current to be supplied from the driving transistor 14 to the organic EL element 15.

The driving transistor 14 is a driving element having a drain connected to a positive power source line 21 that is the second power source line, and having a source connected to the anode of the organic EL element 15. The driving transistor 14 converts the voltage corresponding to the signal voltage applied between the gate and source into a drain current corresponding to the signal voltage. Subsequently, the driving transistor 14 supplies this drain current as the signal current to the organic EL element 15. The driving transistor 14 is configured in form of n-type thin film transistor (n-type TFT), for example.

The organic EL element 15 is a luminescence element having a cathode connected to the negative power source line 22 that is the second power source line, and emits light triggered by the signal current flowing from the driving transistor 14.

The switching transistor 19, as the third switching element, has a gate connected to the scanning line 18 that is the third scanning line, and has a source and drain one of which is connected to the source of the driving transistor 14 and the other of which is connected to an electrode 132 of the electrostatic capacitor 13. The switching transistor 19 has a function of determining a timing with which the potential held by the electrostatic capacitor 13 is applied to between the gate and source of the driving transistor 14. The switching transistor 19 is configured in form of n-type thin film transistor (n-type TFT).

The signal line 16 is connected to a signal line driving circuit 5 and to each of luminescence pixels belonging to a pixel column including the luminescence pixel 10, and has a function of supplying a signal voltage that determines the luminance intensity of the pixels.

In addition, the image display device 1 includes signal lines 16 in number corresponding to the number of pixel columns.

The scanning line 17 concurrently serves as the first scanning line and the second scanning line, is connected to the scanning line driving circuit 4, and is also connected to each of the luminescence pixels belonging to the pixel line including the luminescence pixel 10. With this, the scanning line 17 has a function of supplying a timing with which the signal voltage is written into each of the luminescence pixels belonging to the pixel line including the luminescence pixel 10, and a function of supplying a timing with which the reference voltage VREF is applied to the gate of the driving transistor 14 included in the luminescence pixel.

The scanning line 18 is the third scanning line, and is connected to the scanning line driving circuit 4. With this, the scanning line 18 has a function of supplying a timing with which the potential of the electrode 132 of the electrostatic capacitor 13 is applied to the source of the driving transistor 14.

In addition, the image display device 1 includes scanning lines 17 and 18 in number corresponding to the number of pixel lines.

It is to be noted that each of the reference power source line 20, the positive power source line 21 that is the first power source line, and the negative power source line 22 that is the second power source line is connected to other luminescence pixels and the voltage source.

Next, a description is given of a method of controlling the image display device 1 according to this embodiment with reference to FIGS. 3A to 5B.

Figure 3A:
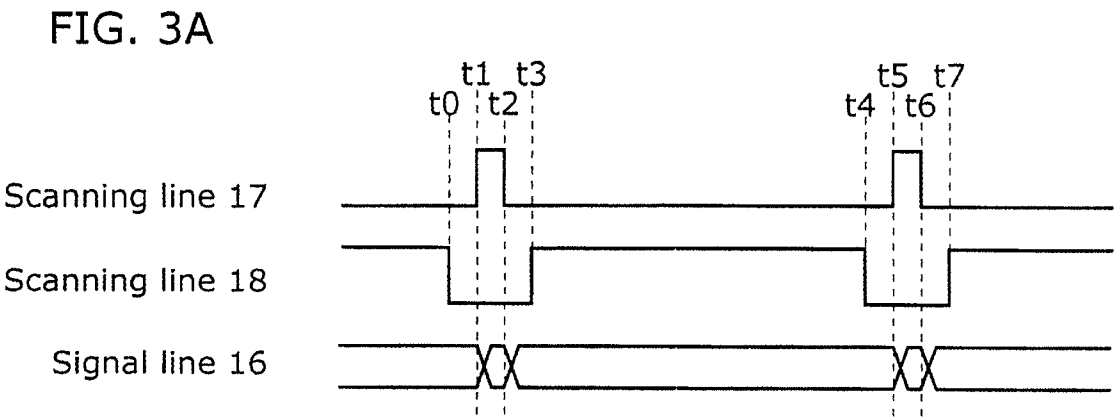
FIG. 3A is a chart showing operation timings in a method of controlling image display devices according to Embodiments 1 and 2 of the present invention.
Figure 4:
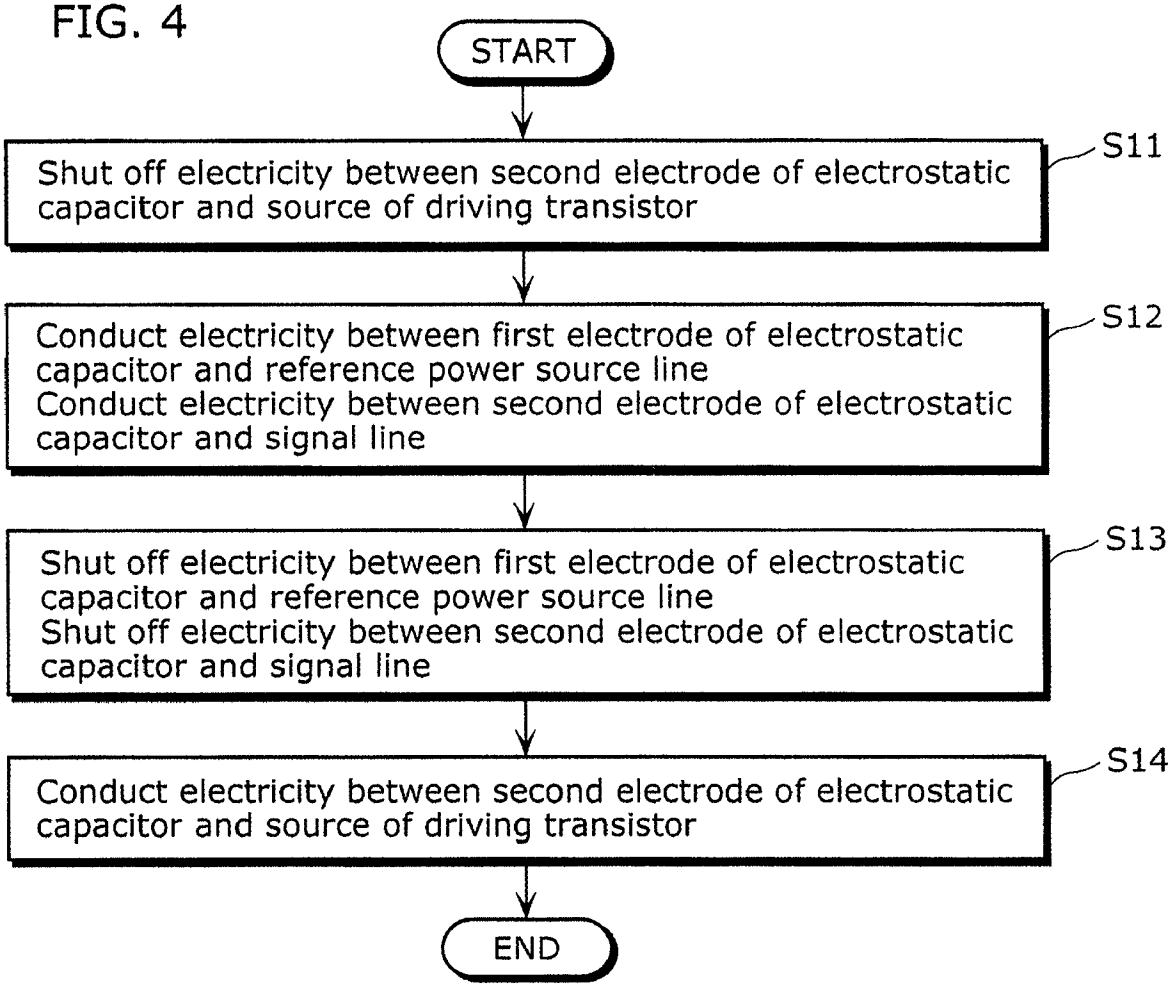
FIG. 4 is a flowchart indicating operations performed by the image display device according to Embodiment 1 of the present invention.

FIG. 3A is a chart showing operation timings in a method of controlling the image display device according to Embodiment 1 of the present invention. In the diagram, the horizontal axis represents time, and in the vertical direction, waveforms of voltages generated in the scanning line 17, the scanning line 18, and the signal line 16 are shown from top to bottom in this sequence. In addition, FIG. 4 is a flowchart of operations performed by the image display device according to Embodiment 1 of the present invention.

First, at Time t0, the scanning line driving circuit 4 changes the voltage level of the scanning line 18 from HIGH to LOW to bring the switching transistor 19 into an off state. With this, the source of the driving transistor 14 and the electrode 132 of the electrostatic capacitor 13 become non-conductive (Step S11 in FIG. 4). For example, in this embodiment, the voltage levels of the scanning line 18 are +20 V in HIGH and −10 V in LOW.

Figure 5B:
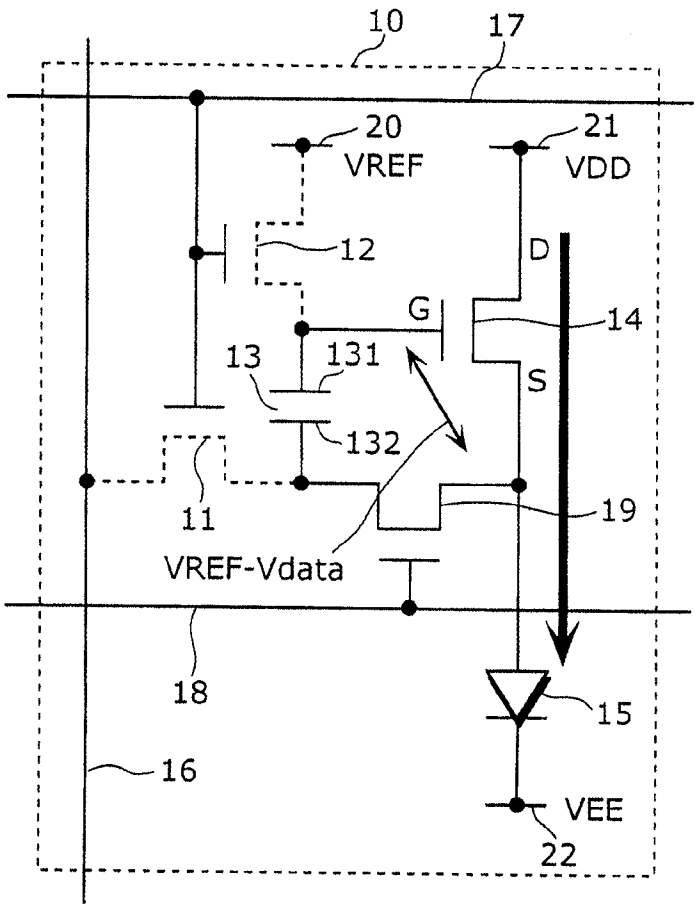
FIG. 5B is a diagram showing a pixel circuit in a conductive state while the image display device according to Embodiment 1 of the present invention is emitting light.
Figure 5A:
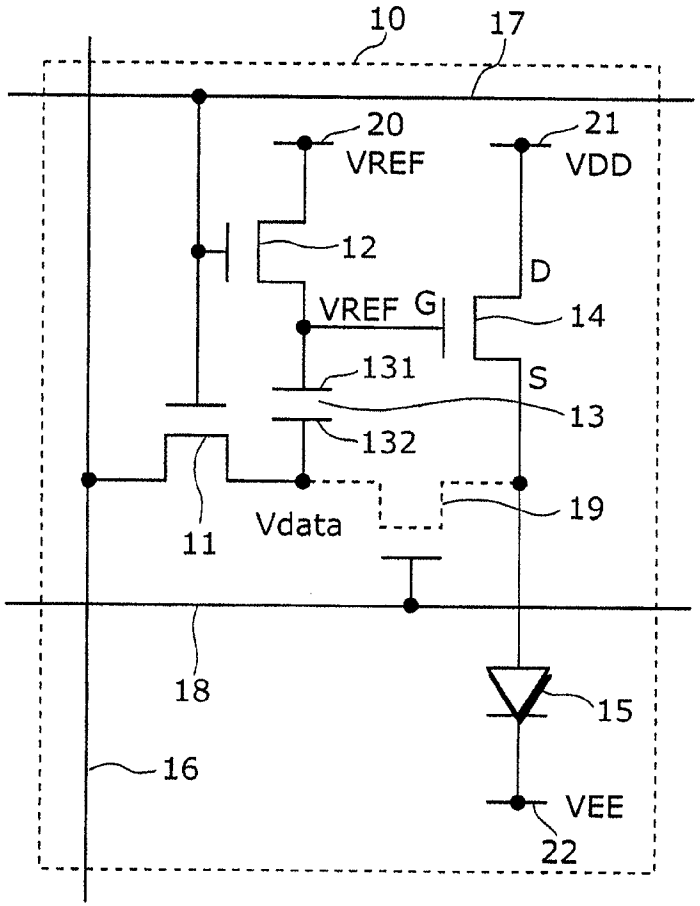
FIG. 5A is a diagram showing a pixel circuit in a conductive state while a signal voltage is being written by the image display device according to Embodiment 1 of the present invention.

Next, at Time t1, the scanning line driving circuit 4 changes the voltage level of the scanning line 17 from LOW to HIGH to bring the switching transistors 11 and 12 into an on state. FIG. 5A is a diagram showing a pixel circuit in a conductive state while a signal voltage is being written by the image display device according to Embodiment 1 of the present invention. As shown in the diagram, the reference voltage VREF of the reference power source line 20 is applied to the electrode 131 of the electrostatic capacitor 13, and the signal voltage Vdata is applied from the signal line 16 to the electrode 132 of the electrostatic capacitor 13 (Step S12 in FIG. 4). In other words, in Step S12, charge corresponding to the signal voltage to be applied to the luminescence pixel 10 is held by the electrostatic capacitor 13.

In addition, the source of the driving transistor 14 and the electrode 132 of the electrostatic capacitor 13 are non-conductive by the operation of Step S11. Further, the reference voltage VREF of the reference power source line 20 is applied to the gate of the driving transistor 14, and the potential for bringing the driving transistor 14 into an off state is set. Thus, no current flows between the source and drain of the driving transistor 14 at this time, and therefore the organic EL element does not emit light. For example, in this embodiment, the voltage levels of the scanning line 17 are +20 V in HIGH and −10 V in LOW. In addition, VREF is set at 0 V, and Vdata is set to be a value within −5 V to 0 V.

Since the voltage level of the scanning line 17 is set to be HIGH during the period from Time t1 to Time t2, the signal voltage Vdata is applied from the signal line 16 to the electrode 132 of the luminescence pixel 10, and at the same time, the signal voltage is supplied to each of the luminescence pixels belonging to the pixel line including the luminescence pixel 10.

Only the capacitive load is connected to the reference power source line 20 during this period, no voltage fall due to a steady current occurs. In addition, the difference in the potential of the drain and source of the switching transistor 12 is 0 V when charging of the electrostatic capacitor 13 is completed. This is true of the relationship between the signal line 16 and the switching transistor 11. Thus, potential VREF and Vdata exactly corresponding to the signal voltage are written into the electrodes 131 and 132 of the electrostatic capacitor 13.

Next, at Time t2, the scanning line driving circuit 4 changes the voltage level of the scanning line 17 from HIGH to LOW to bring the switching transistor 19 into an off state. This shuts off electricity between the electrode 131 of the electrostatic capacitor 13 and the reference power source line 20, and between the electrode 132 of the electrostatic capacitor 13 and the signal line 16 (Step S13 in FIG. 4).

Next, at Time t3, the scanning line driving circuit 4 changes the voltage level of the scanning line 18 from LOW to HIGH to bring the switching transistor 19 into an on state. FIG. 5B is a diagram showing a pixel circuit in a conductive state while the image display device according to Embodiment 1 of the present invention is emitting light. As shown in the diagram, the source of the driving transistor 14 and the electrode 132 of the electrostatic capacitor 13 become conductive (Step S14 in FIG. 4). In addition, the electrode 131 and the electrode 132 of the electrostatic capacitor 13 are cut off from the reference power source line 20 and the signal line 16, respectively. Thus, the gate potential of the driving transistor 14 changes with variation in the source potential, and a both-end voltage (VREF-Vdata) of the electrostatic capacitor 13 is applied to the gate and source. Thereby, a signal current corresponding to the both-end voltage (VREF-Vdata) flows into the organic EL element 15. For example, in this embodiment, the source potential of the driving transistor 14 changes from 0 V to 10 V by conduction of the switching transistor 19. In addition, the voltage VDD of the positive power source line is set at +20 V, and the voltage VEE of the negative power source line is set at 0 V.

During the period from Time t3 to Time t4, the both-end voltage (VREF-Vdata) is being applied to between the gate and source, and the flow of the signal current causes the organic EL element 15 to keep emitting light.

The period from Time t0 to Time t4 corresponds to a frame period by which the light emission intensity of all the luminescence pixels included in the image display device 1 is updated, and operations as in the period from t0 to t4 are repeated at and after t4.

Figure 3B:
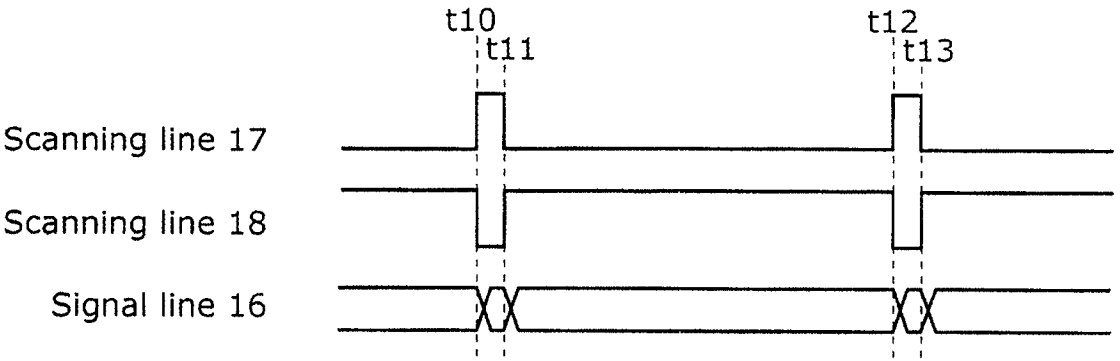
FIG. 3B is a chart showing operation timings in a Variation of a method of controlling the image display devices according to Embodiments 1 and 2 of the present invention.

FIG. 3B is a chart showing operation timings in a Variation of a method of controlling the image display device according to Embodiment 1 of the present invention.

First, at Time t10, the scanning line driving circuit 4 concurrently executes an operation at Time t0 shown in FIG. 3A in Embodiment 1 and an operation at Time t1 shown in FIG. 3A (Steps S11 and S12 in FIG. 4). In other words, the source of the driving transistor 14 and the electrode 132 of the electrostatic capacitor 13 become non-conductive. At the same time, the reference voltage VREF is applied to the electrode 131 of the electrostatic capacitor 13, and the signal voltage Vdata is applied to the electrode 132.

A state realized during the period from Time t10 to Time t11 is similar to the state realized during the period from Time t1 to Time t2 shown in FIG. 3A in Embodiment 1. Since the voltage level of the scanning line 17 is set to be HIGH, the signal voltage Vdata is applied from the signal line 16 to the electrode 132 of the luminescence pixel 10, and at the same time, the signal voltage is supplied to each of the luminescence pixels belonging to the pixel line including the luminescence pixel 10.

In this period, only the capacitive load is connected to the reference power source line 20, and thus no voltage fall due to a steady current occurs. In addition, the difference in the potential of the drain and source of the switching transistor 12 is 0 V when charging of the electrostatic capacitor 13 is completed. This is true of the relationship between the signal line 16 and the switching transistor 11. Thus, potential VREF and Vdata exactly corresponding to the signal voltage are written into the electrodes 131 and 132 of the electrostatic capacitor 13.

Next, at Time t11, the scanning line driving circuit 4 concurrently executes an operation at Time t2 shown in FIG. 3A in Embodiment 1, and an operation at Time t3 shown in FIG. 3A (Steps S13 and S14 in FIG. 4). In other words, the electrode 131 of the electrostatic capacitor 13 and the reference power source line 20 become non-conductive, and the electrode 132 of the electrostatic capacitor 13 and the signal line 16 are non-conductive, whereas the source of the driving transistor 14 and the electrode 132 of the electrostatic capacitor 13 become conductive. At this time, the both-end voltage (VREF-Vdata) of the electrostatic capacitor 13 is applied to between the gate and source of the driving transistor 14, thereby causing a signal current corresponding to the both-end voltage (VREF-Vdata) to flow into the organic EL element 15.

During the period from Time t11 to Time t12, the both-end voltage (VREF-Vdata) is being applied to between the gate and source, and the flow of the signal current causes the organic EL element 15 to keep emitting light.

The period from Time t10 to Time t12 corresponds to a frame period by which the light emission intensity of all the luminescence pixels included in the image display device 1 is updated, and operations as in the period from t10 to t12 are repeated at and after t12.

As described above, with the image display device and the method of controlling the same according to Embodiment 1 of the present invention, only a current passing through a luminescence element flows into a driving transistor, and no steady current flows in a power source line and a signal line. Thus, it is possible to store an accurate potential into both end electrodes of the electrostatic capacitor having a function of holding a voltage to be applied to between the gate and source of the driving transistor, thereby achieving a highly accurate image display reflecting a video signal.

It is to be noted that, in this embodiment, it is possible to control a timing in Time t3 and Time t4 for the scanning line 18 independently of a timing for the scanning line 17 in the operation timings shown in FIG. 3A, thereby arbitrarily adjusting light emitting time in a frame period, that is, adjusting duty control. On the other hand, as for the operation timings shown in FIG. 3B, the scanning lines 17 and 18 cooperate. This simplifies the scanning line control circuit, thereby reducing the circuit size. In the case where the switching transistor 11 and the switching transistor 12 are of n(p)-type, and the switching transistor 19 is of p(n)-type, it is possible to reduce the number of outputs of the scanning line driving circuit 4 by configuring the scanning lines 17 and 18 as a common line, whereas it is impossible to perform duty control and thus 100% light emission is kept in a frame period.

Embodiment 2

An image display device in this embodiment includes luminous pixels arranged in a matrix. Each of the luminous pixels includes: a luminescence element; a capacitor; a driving element having a gate connected to a first electrode of the capacitor and having a source connected to the luminescence element; a third switching element for switching between conductive and non-conductive states between the source of the driving element and the second electrode of the capacitor; a first switching element for switching between conductive and non-conductive states between a reference power source line and a second electrode of the capacitor; and a second switching element for switching between conductive and non-conductive states between a data line and a first electrode of the capacitor. This configuration enables storage of an accurate potential corresponding to a signal voltage onto both end terminals of the capacitor. This makes it possible to achieve an accurate image display reflecting a video signal.

This embodiment of the present invention will be described below with reference to the drawings.

Figure 6:
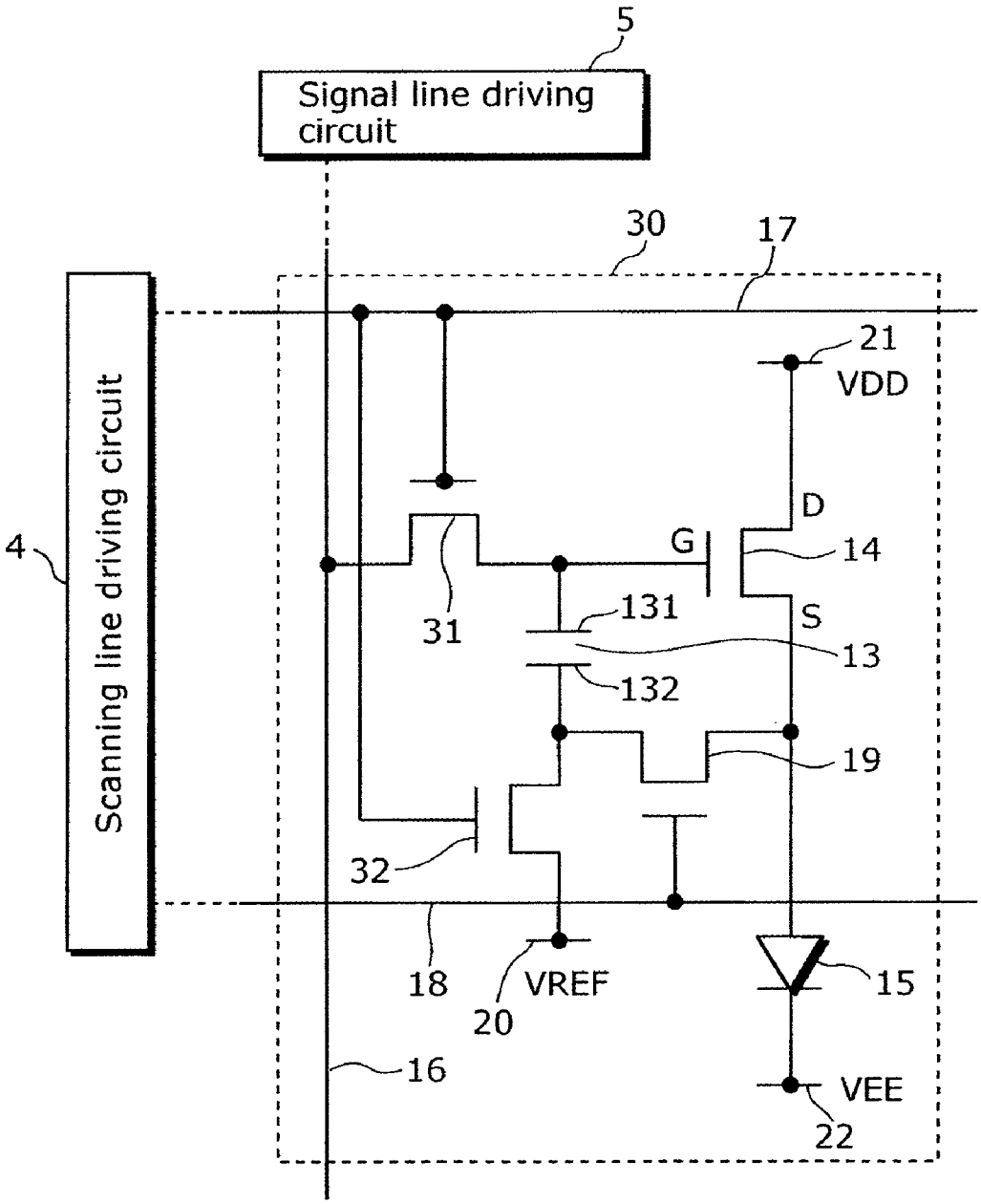
FIG. 6 is a diagram showing a circuit configuration of a luminescence pixel included in a display unit and connections with the surrounding circuits according to Embodiment 2 of the present invention.

FIG. 6 is a diagram showing a circuit configuration of a luminescence pixel included in a display unit and connections with the surrounding circuits according to Embodiment 2 of the present invention. The luminescence pixel 30 in the diagram includes switching transistors 19, 31, and 32, an electrostatic capacitor 13, a driving transistor 14, an organic EL element 15, a signal line 16, scanning lines 17 and 18, a reference power source line 20, a positive power source line 21, and a negative power source line 22. In addition, the surrounding circuits include a scanning line driving circuit 4 and a signal line driving circuit 5.

The luminescence pixel 30 according to this embodiment is structurally different from the luminescence pixel 10 according to Embodiment 1 only in the connection of the switching transistor to the both end electrodes of the electrostatic capacitor 13.

The connection relationships and functions of the structural elements shown in FIG. 6 will be described below in terms of the differences from the structural elements according to Embodiment 1 shown in FIG. 2 and the already-given descriptions are not repeated.

The scanning line driving circuit 4 is connected to the scanning lines 17 and 18, and functions as a driving circuit for controlling between conductive and non-conductive states of the switching transistors 19, 31, and 32 included in the luminescence pixel 30 by outputting a scanning signal to the scanning lines 17 and 18.

The signal line driving circuit 5 is connected to the signal line 16, and functions as a driving circuit for outputting a signal voltage based on a video signal to the luminescence pixel 30.

The switching transistor 31, as the second switching element, has a gate connected to the scanning line 17 that is the second scanning line, and has a source and drain one of which is connected to the signal line 16 that is the data line and the other of which is connected to an electrode 131 of the electrostatic capacitor 13. The switching transistor 31 has a function of determining a timing with which the signal voltage of the signal line 16 is applied to the electrode 131 of the electrostatic capacitor 13.

The switching transistor 32, as the first switching element, has a gate connected to the scanning line 17 that is the first scanning line, and has a source and drain one of which is connected to the reference power source line 20 and the other of which is connected to an electrode 132 of the electrostatic capacitor 13. The switching transistor 32 has a function of determining a timing with which the reference voltage VREF of the reference power source line 20 is applied to the electrode 132 of the electrostatic capacitor 13. The switching transistors 31 and 32 are configured in form of n-type thin film transistors (n-type TFTs).

The electrostatic capacitor 13 holds the charge corresponding to the signal voltage supplied from the signal line 16. In the case where the switching transistors 31 and 32 are brought into an off state, the electrostatic capacitor 13 exerts the function of causing the driving transistor 14 to hold a constant potential between its gate and source electrodes, and thereby stabilizing a current to be supplied from the driving transistor 14 to the organic EL element 15.

The signal line 16 is connected to a signal line driving circuit 5, and to each of luminescence pixels belonging to a pixel column including the luminescence pixel 30, and has a function of supplying a signal voltage that determines the luminance intensity of the pixels.

In addition, the image display device according to Embodiment 2 includes signal lines 16 in number corresponding to the number of pixel columns.

With this, the scanning line 17 has a function of supplying a timing with which the signal voltage is written into each of the luminescence pixels belonging to the pixel line including the luminescence pixel 30, and a function of supplying a timing with which the reference voltage VREF is applied to the gate of the driving transistor 14 included in the luminescence pixel.

Next, a description is given of a method of controlling the image display device according to this embodiment with reference to FIGS. 3A to 7.

Figure 7:
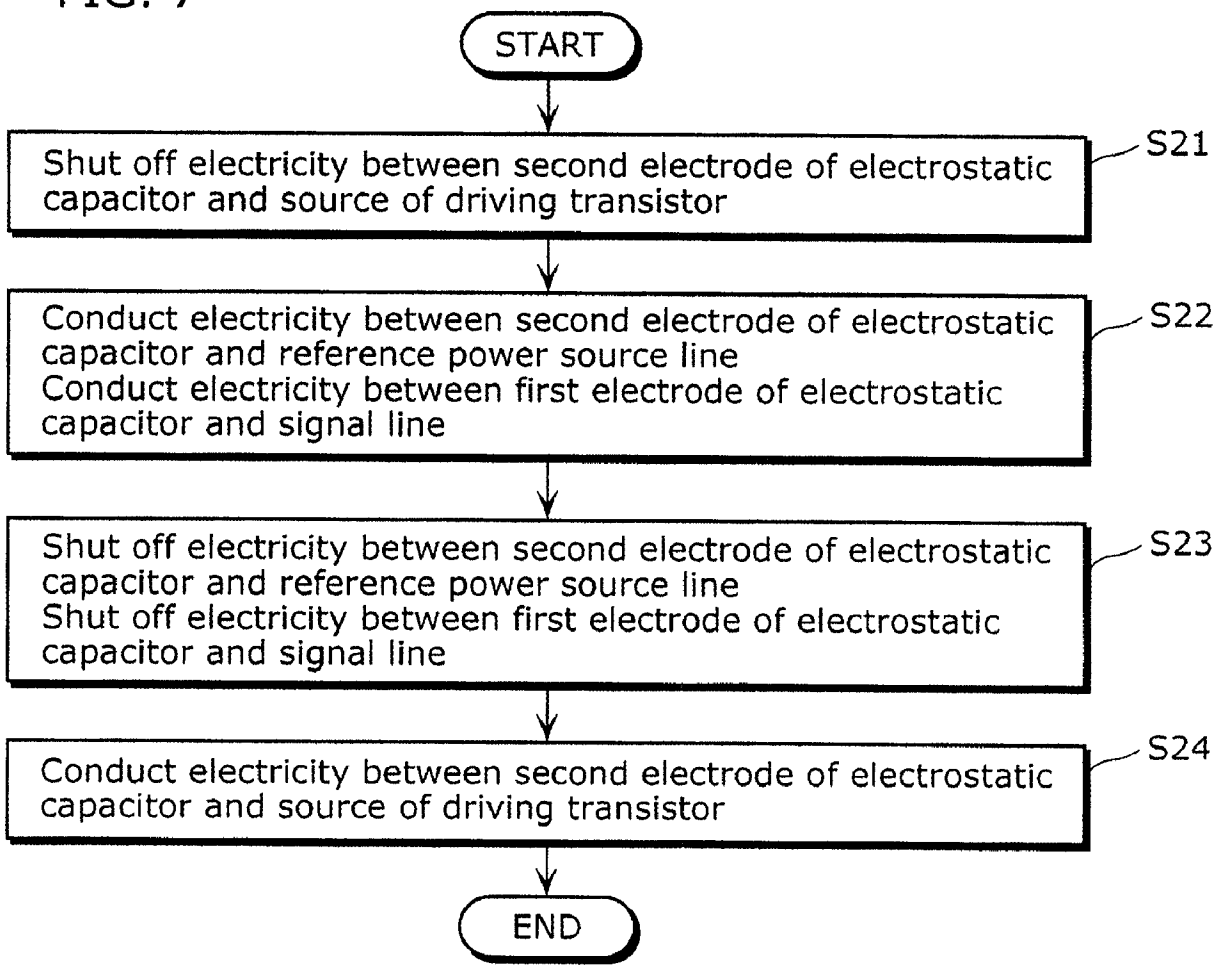
FIG. 7 is a flowchart of operations performed by the image display device according to Embodiment 2 of the present invention.

FIG. 3A is a chart showing operation timings in a method of controlling the image display device according to Embodiments 2 of the present invention. In addition, FIG. 7 is a flowchart of operations performed by the image display device according to Embodiment 2 of the present invention.

First, at Time t0, the scanning line driving circuit 4 changes the voltage level of the scanning line 18 from HIGH to LOW to bring the switching transistor 19 into an off state. With this, the source of the driving transistor 14 and the electrode 132 that is the second electrode of the electrostatic capacitor 13 become non-conductive (Step S21 in FIG. 7). For example, in this embodiment, the voltage levels of the scanning line 18 are +20 V in HIGH and −10 V in LOW.

Next, at Time t1, the scanning line driving circuit 4 changes the voltage level of the scanning line 17 from LOW to HIGH to bring the switching transistors 31 and 32 into an on state. At this time, the signal voltage Vdata is applied from the signal line 16 to the electrode 131 that is the first electrode of the electrostatic capacitor 13, and the reference voltage VREF of the reference power source line 20 is applied to the electrode 132 of the electrostatic capacitor 13 (Step S22 in FIG. 7). In other words, in Step S22, charge corresponding to the signal voltage to be applied to the luminescence pixel 30 is held by the electrostatic capacitor 13.

In addition, the source of the driving transistor 14 and the electrode 132 of the electrostatic capacitor 13 are non-conductive by the operation of Step S21. The maximum potential VDH of the signal line 16 is set to a potential that brings the driving transistor 14 into an off state upon application at its gate. Thus, no current flows between the source and drain of the driving transistor 14 at this time, and therefore the organic EL element does not emit light. For example, in this embodiment, VREF, Vdate, VDD, and VEE are set to 0 V, −5 V (VDH) to 0 V, +20 V, and 0 V, respectively.

Further, the maximum signal potential VDH of the potential VREF of the reference power source line 20 is adjusted so as to supply a current having the maximum signal value to the organic EL element 15 when the voltage between the gate and source of the driving transistor 14 is the voltage (VDH-VREF) in later-described Step S24.

Since the voltage level of the scanning line 17 is set to be HIGH during the period from Time t1 to Time t2, the signal voltage Vdata is applied from the signal line 16 to the electrode 131 of the luminescence pixel 30, and at the same time, the signal voltage is supplied to each of the luminescence pixels belonging to the pixel line including the luminescence pixel 30.

During this period, the electrodes 131 and 132 of the electrostatic capacitor 13 are separated from the positive power source line 21 which supplies a current to the organic EL element 15, the negative power source line 22, and the anode of the organic EL element 15. Accordingly, only the capacitive load is connected to the reference power source line 20, and thus no voltage fall due to a steady current occurs. In addition, the difference in the potential of the drain and source of the switching transistor 32 is 0 V when charging of the electrostatic capacitor 13 is completed. This is true of the relationship between the signal line 16 and the switching transistor 31. In this way, the voltage Vdata and VREF exactly corresponding to the signal voltage are written into each of the electrodes 131 and 132 of the electrostatic capacitor 13.

Next, at Time t2, the scanning line driving circuit 4 changes the voltage level of the scanning line 17 from HIGH to LOW to bring the switching transistors 31 and 31 into an off state.

This shuts off electricity between the electrode 131 of the electrostatic capacitor 13 and the signal line 16, and between the electrode 132 of the electrostatic capacitor 13 and the reference power source line 20 (Step S23 in FIG. 7).

Next, at Time t3, the scanning line driving circuit 4 changes the voltage level of the scanning line 18 from LOW to HIGH to bring the switching transistor 19 into an on state. At this time, the source of the driving transistor 14 and the electrode 132 of the electrostatic capacitor 13 become conductive (Step S24 in FIG. 7). In addition, the electrode 131 and the electrode 132 of the electrostatic capacitor 13 are cut off from the signal line 16 and the reference power source line 20, respectively. Since the gate potential of the driving transistor 14 changes, and a difference in the potential of both-end voltage (Vdata-VREF) of the electrostatic capacitor 13 is applied, a signal current corresponding to the both-end voltage (Vdata-VREF) flows into the organic EL element 15. For example, in this embodiment, the source potential of the driving transistor 14 changes from +2 V to +10 V by conduction of the switching transistor 19. In addition, the voltage VDD of the positive power source line is set at +20 V, and the voltage VEE of the negative power source line is set at 0 V.

During the period from Time t3 to Time t4, the both-end voltage (Vdata-VREF) is being applied to between the gate and source, and the flow of the signal current causes the organic EL element 15 to keep emitting light.

The period from Time t0 to Time t4 corresponds to a frame period by which the light emission intensity of all the luminescence pixels is updated, and operations as in the period from t1 to t4 are repeated at and after t4.

FIG. 3B is a chart showing operation timings in a Variation of a method of controlling the image display device according to Embodiment 2 of the present invention.

First, at Time t10, the scanning line driving circuit 4 concurrently executes an operation at Time t0 shown in FIG. 3A in Embodiment 2 and an operation at Time t1 shown in FIG. 3A (Steps S21 and S22 in FIG. 7). In other words, the source of the driving transistor 14 and the electrode 132 of the electrostatic capacitor 13 become non-conductive. At the same time, the signal voltage Vdata is applied to the electrode 131 of the electrostatic capacitor 13, and the reference voltage VREF is applied to the electrode 132.

A state realized during the period from Time t10 to Time t11 is similar to the state realized during the period from Time t1 to Time t2 shown in FIG. 3A in Embodiment 2. Since the voltage level of the scanning line 17 is set to be HIGH, the signal voltage Vdata is applied from the signal line 16 to the electrode 131 of the luminescence pixel 30, and at the same time, the signal voltage is supplied to each of the luminescence pixels belonging to the pixel line including the luminescence pixel 30.

In this period, only the capacitive load is connected to the reference power source line 20, and thus no voltage fall due to a steady current occurs. In addition, the difference in the potential of the drain and source of the switching transistor 32 is 0 V when charging of the electrostatic capacitor 13 is completed. This is true of the relationship between the signal line 16 and the switching transistor 31. In this way, the voltage Vdata and VREF exactly corresponding to the signal voltage are written into each of the electrodes 131 and 132 of the electrostatic capacitor 13.

Next, at Time t11, the scanning line driving circuit 4 concurrently executes an operation at Time t2 shown in FIG. 3A in Embodiment 2, and an operation at Time t3 shown in FIG. 3A (Steps S23 and S24 in FIG. 7). In other words, the electrode 131 of the electrostatic capacitor 13 and the signal line 16 become non-conductive, and the electrode 132 of the electrostatic capacitor 13 and the reference power source line 20 are non-conductive, whereas the source of the driving transistor 14 and the electrode 132 of the electrostatic capacitor 13 become conductive. At this time, the both-end voltage (Vdata-VREF) is applied to between the gate and source of the driving transistor 14, a signal current corresponding to the both-end voltage (Vdata-VREF) flows into the organic EL element 15.

During the period from Time t11 to Time t12, the both-end voltage (Vdata-VREF) is being applied to between the gate and source, and the flow of the signal current causes the organic EL element 15 to keep emitting light.

The period from Time t10 to Time t12 corresponds to a frame period by which the light emission intensity of all the luminescence pixels is updated, and operations as in the period from t1 to t12 are repeated at and after t12.

On the other hand, as for the operation timings shown in FIG. 3B, the scanning lines 17 and 18 cooperate. This simplifies the scanning line control circuit, thereby reducing the circuit size. In the case where the switching transistor 31 and the switching transistor 32 are of n(p)-type, and the switching transistor 19 is of p(n)-type, it is possible to reduce the number of outputs of the scanning line driving circuit 4 by configuring the scanning lines 17 and 18 as a common line.

As described above, with the image display device and the method of controlling the same according to Embodiment 2 of the present invention, only a current passing through a luminescence element flows into a driving transistor, and no steady current flows in a power source line and a signal line. Thus, it is possible to store an accurate potential into both end electrodes of the electrostatic capacitor having a function of holding a voltage to be applied to between the gate and source of the driving transistor, thereby achieving a highly accurate image display reflecting a video signal.

Embodiment 3

An image display device in this embodiment includes luminescence pixels arranged in a matrix. Each of the luminous pixels includes: a luminescence element; a capacitor; a driving element having a gate connected to a first electrode of the capacitor and having a source connected to the luminescence element; a third switching element for switching between conductive and non-conductive states between the source of the driving element and the second electrode of the capacitor; a first switching element for switching between conductive and non-conductive states between a first reference power source line and a first electrode of the capacitor; a second switching element for switching between conductive and non-conductive states between a data line and a second electrode of the capacitor, and a second capacitor connected to between the second electrode of the capacitor and the second reference power source line. This configuration enables storage of an accurate potential corresponding to a signal voltage onto both end terminals of the capacitor, thereby achieving a light emission which is constant irrespective of whether the third switching element is in an on state or in an off state.

An embodiment of the present invention will be described below with reference to the drawings.

Figure 8:
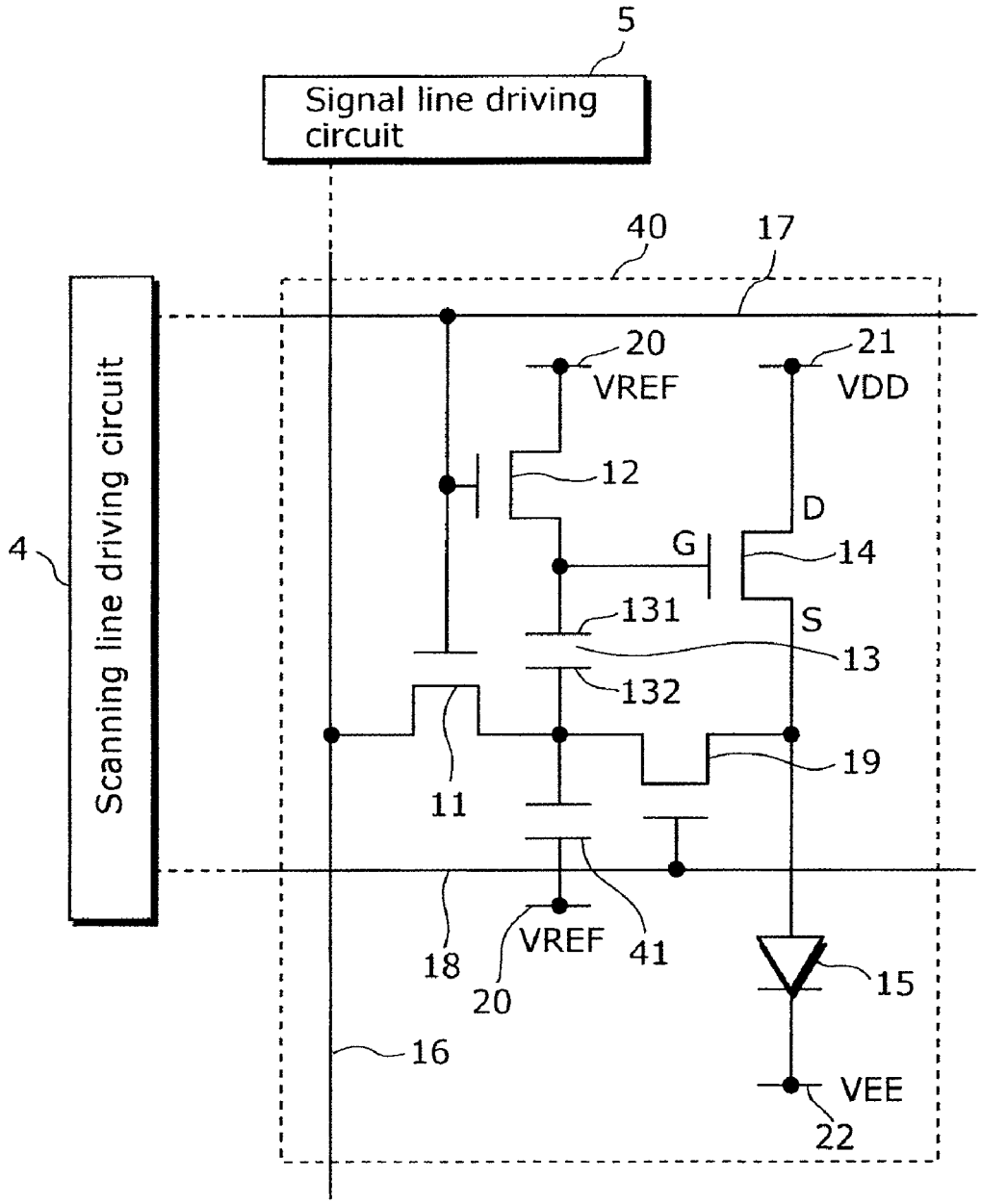
FIG. 8 is a diagram showing a circuit configuration of a luminescence pixel included in a display unit and connections with the surrounding circuits according to Embodiment 3 of the present invention.

FIG. 8 is a diagram showing a circuit configuration of a luminescence pixel included in a display unit and connections with the surrounding circuits according to Embodiment 3 of the present invention. The luminescence pixel 40 in the diagram includes switching transistors 11, 12, and 19, electrostatic capacitors 13 and 41, a driving transistor 14, an organic EL element 15, a signal line 16, scanning lines 17 and 18, a reference power source line 20, a positive power source line 21, and a negative power source line 22. In addition, the surrounding circuits include a scanning line driving circuit 4 and a signal line driving circuit 5.

The luminescence pixel 40 according to this embodiment is structurally different from the luminescence pixel 10 according to Embodiment 1 only in that the electrostatic capacitor 41 is connected between the electrode 132 of the electrostatic capacitor 13 and the reference power source line 20.

The connection relationships and functions of the structural elements shown in FIG. 8 will be described in terms of the differences from the structural elements according to Embodiment 1 shown in FIG. 2, and the already-given descriptions are not repeated.

The electrostatic capacitor 41 is the second capacitor connected between the electrode 132 that is the second electrode of the electrostatic capacitor 13 and the reference power source line 20 that is the fourth power source line. First, the electrostatic capacitor 41 stores the constant source potential of the driving transistor 14 in a state where the switching transistor 19 is conductive. Since the potential of the electrode 132 of the electrostatic capacitor 13 is fixed even after the switching transistor 19 is brought into an off state, the gate voltage of the driving transistor 14 is also fixed. On the other hand, the potential of the driving transistor 14 is already constant. As a result, the electrostatic capacitor 41 has a function of stabilizing the voltage between the gate and source of the driving transistor 14.

It is to be noted that the electrostatic capacitor 41 may be connected to a reference power source line other than the reference power source line 20 that is the first power source line connected to one of the source and drain of the switching transistor 12. For example, the electrostatic capacitor 41 may be a positive power source VDD or a negative power source VEE. In this case, the layout flexibility increases, and thus a wide space is secured between elements, thereby achieving an increased yield.

On the other hand, as in this embodiment, the use of a common reference power source makes it possible to reduce the number of reference power source lines, thereby simplifying the pixel circuitry.

Figure 9:
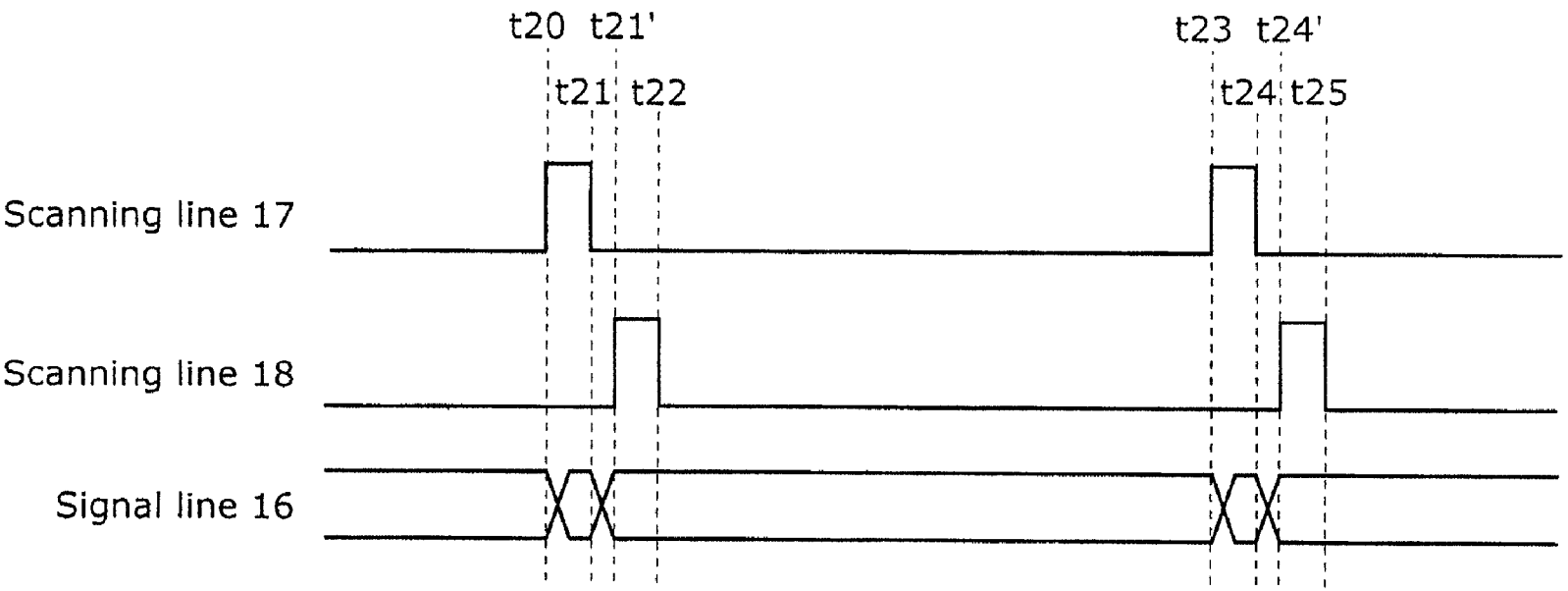
FIG. 9 is a chart showing operation timings in a method of controlling an image display device according to Embodiment 3 of the present invention.
Figure 10:
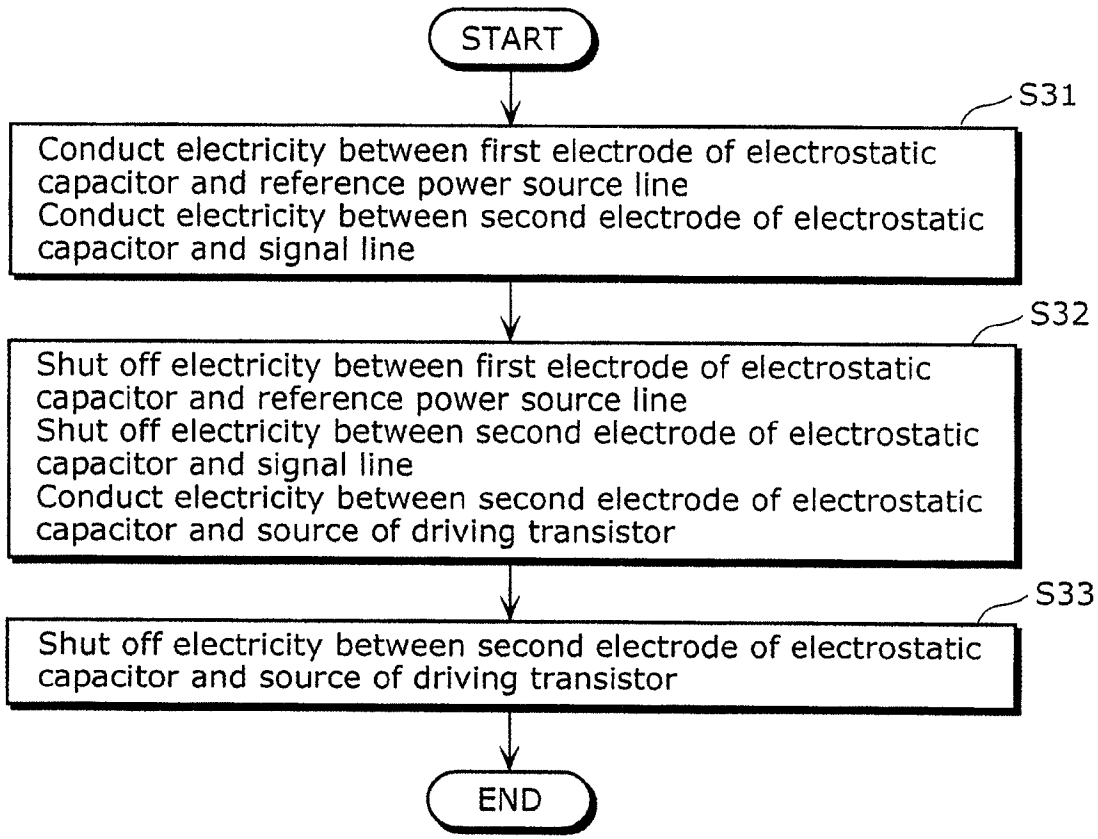
FIG. 10 is a flowchart of operations performed by the image display device according to Embodiment 3 of the present invention.

Next, a description is given of a method of controlling the image display device according to this embodiment with reference to FIGS. 9 to 10.

FIG. 9 is a chart showing operation timings in a method of controlling an image display device according to Embodiment 3 of the present invention. In addition, FIG. 10 is a flowchart of operations performed by the image display device according to Embodiment 3 of the present invention.

Next, at Time t20, the scanning line driving circuit 4 changes the voltage level of the scanning line 17 from LOW to HIGH to bring the switching transistors 11 and 12 into an on state. At this time, the reference voltage VREF is applied to the electrode 131 that is the first electrode of the electrostatic capacitor 13, and the signal voltage Vdata is applied from the signal line 16 to the electrode 132 that is the second electrode of the electrostatic capacitor 13 (Step S31 in FIG. 10). In other words, in Step S31, charge corresponding to the signal voltage to be applied to the luminescence pixel 40 is held by the electrostatic capacitor 13.

Since the voltage level of the scanning line 17 is set to be HIGH during the period from Time t20 to Time t21, the signal voltage Vdata is applied from the signal line 16 to the electrode 132 of the luminescence pixel 40, and at the same time, the signal voltage is supplied to each of the luminescence pixels belonging to the pixel line including the luminescence pixel 40.

In this period, only the capacitive load is connected to the reference power source line 20, and thus no voltage fall due to a steady current occurs. Thus, the difference in the potential generated between the drain and source of the switching transistor 12 is 0 V when charging of the electrostatic capacitor 13 is completed. This is true of the relationship between the signal line 16 and the switching transistor 11. Thus, potential VREF and Vdata exactly corresponding to the signal voltage are written into the electrodes 131 and 132 of the electrostatic capacitor 13.

Next, at Time t21, the scanning line driving circuit 4 changes the voltage level of the scanning line 17 from HIGH to LOW to bring the switching transistors 11 and 12 into an off state. This conducts electricity between the electrode 131 of the electrostatic capacitor 13 and the reference power source line 20, and between the electrode 132 of the electrostatic capacitor 13 and the signal line 16 (Step S32 in FIG. 10).

At Time t21' later than Time t21 by a minute time, the scanning line driving circuit 4 changes the voltage level of the scanning line 18 from LOW to HIGH to turn on the switching transistor 19. With this, the source of the driving transistor 14 and the electrode 132 of the electrostatic capacitor 13 become conductive (Step S32 in FIG. 10). In addition, the electrode 131 and the electrode 132 of the electrostatic capacitor 13 are cut off from the reference power source line 20 and the signal line 16, respectively. Thus, the gate potential of the driving transistor 14 changes, and a both-end voltage (VREF-Vdata) of the electrostatic capacitor 13 is applied to between the gate and source. Thereby, a signal current corresponding to the both-end voltage (VREF-Vdata) flows into the organic EL element 15. In this embodiment, the source potential of the driving transistor 14, the voltage VDD of the positive power source line, and the voltage VEE of the negative power source line are, for example, the same as the voltages described in Embodiment 1.

During the period from Time t21' to Time t22, the both-end voltage (VREF-Vdata) is being applied between the gate and source, and the flow of the signal current causes the organic EL element 15 to keep emitting light.

Next, at Time t22, the scanning line driving circuit 4 changes the voltage level of the scanning line 18 from HIGH to LOW to bring the switching transistor 19 into an off state (Step S33 in FIG. 10). At this time, as long as the source potential of the driving transistor 14 is in a steady state, the electrostatic capacitor 41 stores the source potential even when the switching transistor 19 is in an off state. Thus, the potential of the electrode 132 of the electrostatic capacitor 13 is fixed, resulting in stabilization of the potential of the electrode 13, that is, the gate potential of the driving transistor 14. On the other hand, since the source potential of the driving transistor 14 is constant during a steady state, the voltage between the gate and source of the driving transistor 14 is stabilized. In other words, the signal current is stabilized as long as the source potential of the driving transistor 14 is in a steady state, irrespective of whether the switching transistor 19 is in an on state or in an off state.

As long as the aforementioned operations enable the luminescence pixel 40 to enter into a steady state within a horizontal period, the scanning signal waveform of and the timing for the scanning line 18 can be made the same as the scanning signal waveform of and the timing for the scanning line 17 connected to the luminescence pixel positioned downstream in the same column.

Figure 11:
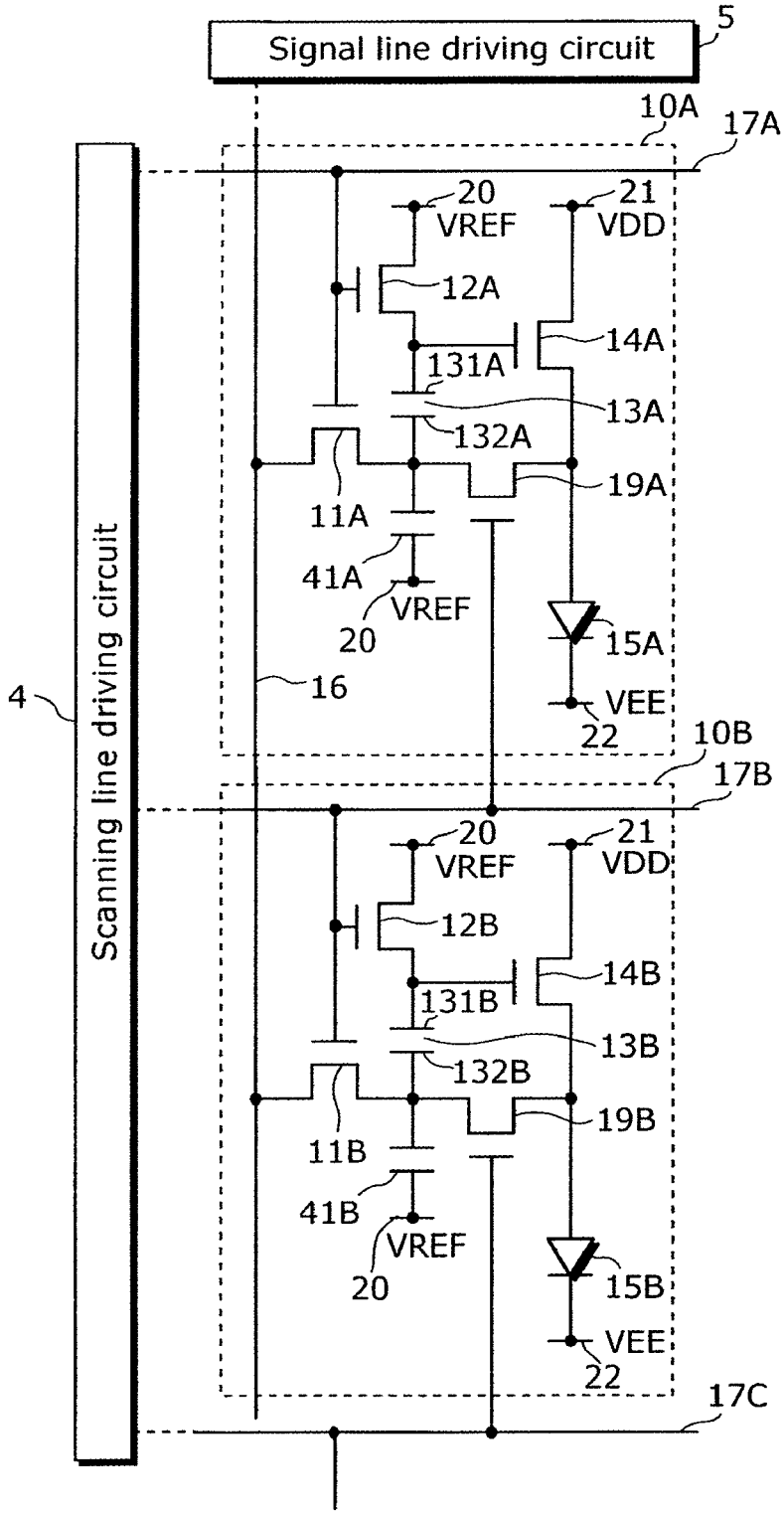
FIG. 11 is a diagram showing a circuit configuration indicating a Variation of luminescence pixels included in a display unit and connections with the surrounding circuits according to Embodiment 3 of the present invention.

FIG. 11 is a diagram showing a circuit configuration of a luminescence pixel included in a display unit and connections with the surrounding circuits according to a Variation of Embodiment 3 of the present invention. The luminescence pixel 10A in the diagram includes: switching transistors 11A, 12A, and 19A; electrostatic capacitors 13A and 41A; a driving transistor 14A; an organic EL element 15A; a signal line 16; scanning lines 17A and 17B; a reference power source line 20; a positive power source line 21; and a negative power source line 22. In addition, the electro-luminescence pixel 10B includes: switching transistors 11B, 12B, and 19B; electrostatic capacitors 13B and 41B; a driving transistor 14B; an organic EL element 15B; a signal line 16; scanning lines 17B and 17C; a reference power source line 20; a positive power source line 21; and a negative power source line 22. In addition, the surrounding circuits include a scanning line driving circuit 4 and a signal line driving circuit 5.

The circuit configurations of the luminescence pixels 10A and 10B and the functions of the respective structural elements in each circuit are the same as in those of the luminescence pixel 40 shown in FIG. 8, and thus the same descriptions are not repeated here.

The luminescence pixel 10B is in the same pixel column in which the luminescence pixel 10A is positioned, and is positioned downstream of the luminescence pixel 10A by a line.

The scanning line 17B connected to the luminescence pixel 10A is connected also to the luminescence pixel 10B.

Figure 12:
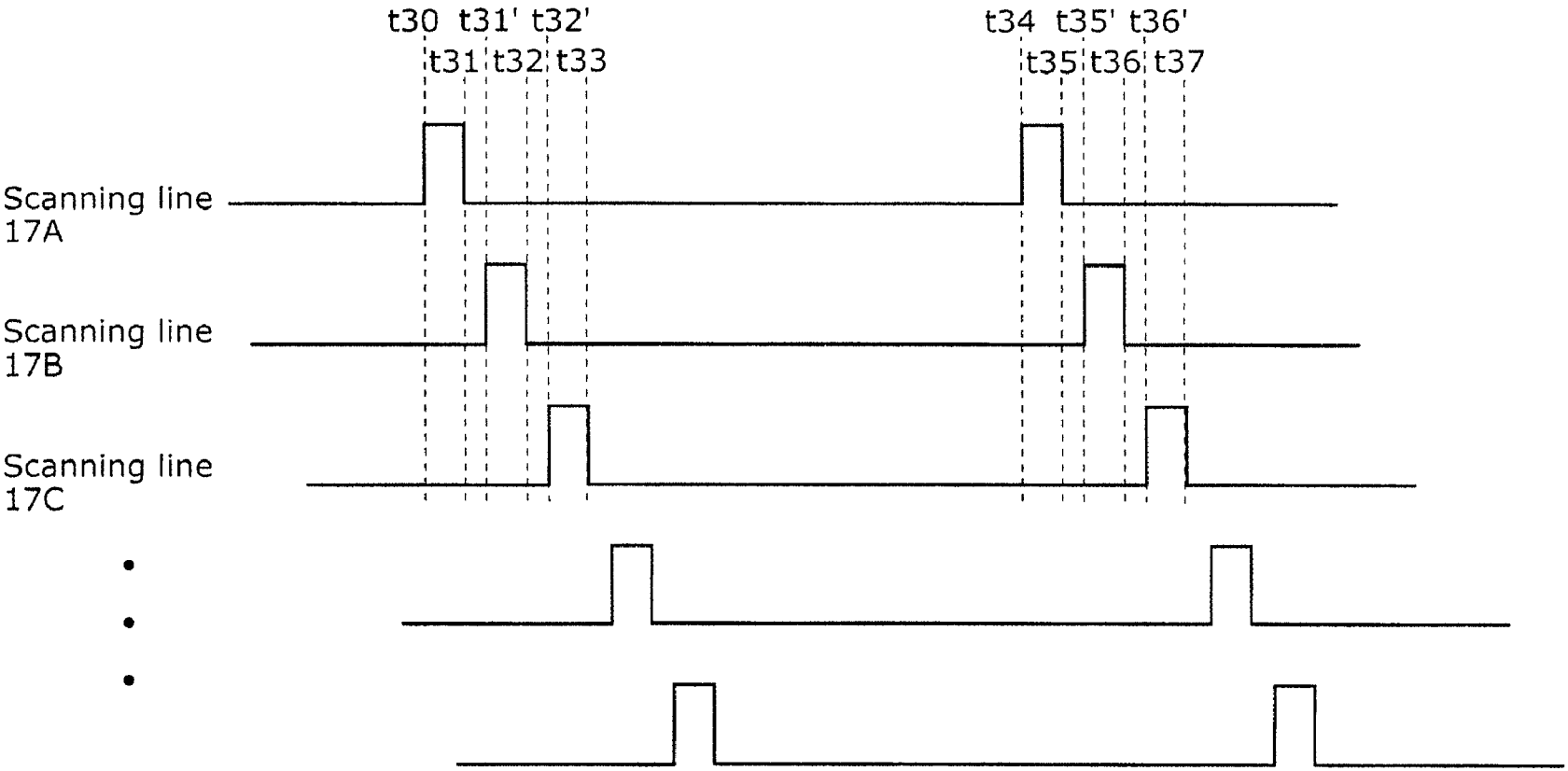
FIG. 12 is a chart showing operation timings in a Variation of the method of controlling luminescence pixels in the image display device according to Embodiment 3 of the present invention.
Figure 13:
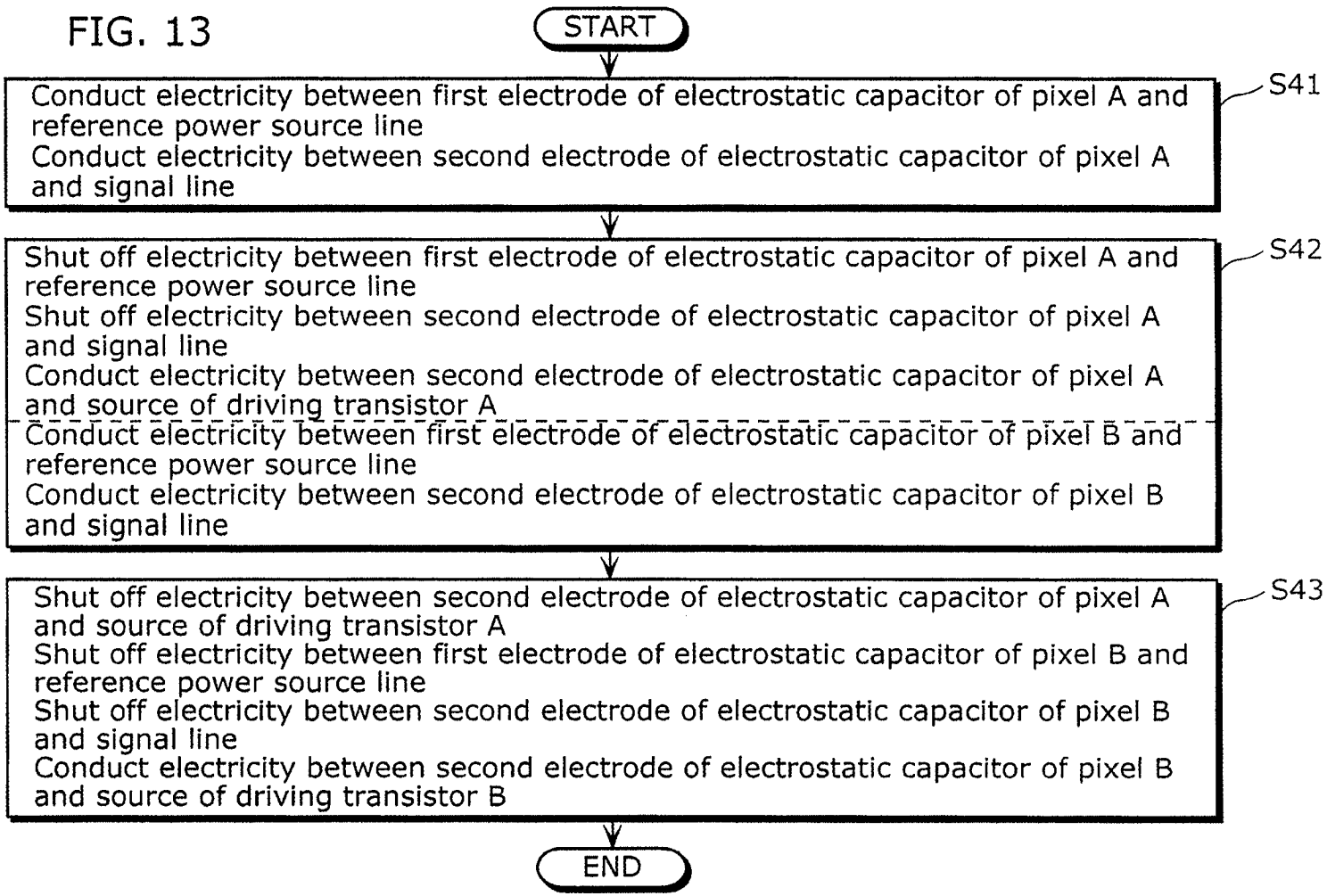
FIG. 13 is an operation flowchart indicating a Variation of luminescence pixels in the image display device according to Embodiment 3 of the present invention.

Next, a description is given of a method of controlling the image display device according to this embodiment with reference to FIGS. 12 to 13.

FIG. 12 is a chart showing operation timings in a Variation of the method of controlling luminescence pixels in the image display device according to Embodiment 3 of the present invention. FIG. 13 is an operation flowchart indicating a Variation of a luminescence pixel in the image display device according to Embodiment 3 of the present invention.

First, at Time t30, the scanning line driving circuit 4 changes the voltage level of the scanning line 17A from LOW to HIGH to bring the switching transistors 11A and 12A into an on state. At this time, the reference voltage VREF of the reference power source line 20 is applied to the electrode 131A that is the first electrode of the electrostatic capacitor 13A, and the signal voltage $V_A$data is applied to the electrode 132A that is the second electrode (Step S41 in FIG. 13).

Since the voltage level of the scanning line 17A is HIGH during the period from Time t30 to Time t31, the signal voltage $V_A$data is applied from the signal line 16 to the electrode 132A of the luminescence pixel 10A that is a pixel A, and at the same time, the signal voltage is supplied to each of the luminescence pixels belong to the pixel line in which the luminescence pixel 10A is included.

In this period, an accurate potential corresponding to the signal voltage $V_A$data is written into the electrostatic capacitor 13A.

Next, at Time t31, the scanning line driving circuit 4 changes the voltage level of the scanning line 17A from HIGH to LOW to bring the switching transistors 11A and 12A into an off state. This shuts off electricity between the electrode 131A of the electrostatic capacitor 13A and the reference power source line 20, and between the electrode 132A of the electrostatic capacitor 13A and the signal line 16 (Step S42 in FIG. 13).

At Time t31' later than Time t31 by a minute time, the scanning line driving circuit 4 changes the voltage level of the scanning line 17B from LOW to HIGH to turn on the switching transistor 19A. With this, the source of the driving transistor 14A and the electrode 132A of the electrostatic capacitor 13A become conductive (Step S42 in FIG. 13). In addition, the electrode 131A of the electrostatic capacitor 13A is cut off from the reference power source line 20, and the electrode 132A is cut off from the signal line 16. Thus, the gate potential of the driving transistor 14A changes, and a signal current corresponding to the voltage (VREF-$V_A$data) flows into the organic EL element 15A.

In addition, at Time t31', the scanning line driving circuit 4 turns on the switching transistors 11B and 12B in the luminescence pixel 10B that is a pixel B by changing the voltage level of the scanning line 17B from LOW to HIGH. At this time, the reference voltage VREF of the reference power source line 20 is applied to the electrode 131B that is the first electrode of the electrostatic capacitor 13B, and the signal voltage $V_B$data is applied from the signal line 16 to the electrode 132B that is the second electrode (Step S42 in FIG. 13).

Since the voltage level of the scanning line 17B is HIGH during the period from Time t31 to Time t32, the signal voltage $V_B$data is applied from the signal line 16 to the electrode 132B of the luminescence pixel 10B, and at the same time, the signal voltage is supplied to each of the luminescence pixels belonging to the pixel line including the luminescence pixel 10B.

In this period, an accurate potential corresponding to the signal voltage $V_B$data is written into the electrostatic capacitor 13B.

During this period, a both-end voltage (VREF-$V_A$data) of the electrostatic capacitor 13A is being applied to between the gate and source of the driving transistor 14A in the luminescence pixel 10A, and a flow of a driving current enables the organic EL element 15A to keep emitting light.

Next, at Time t32, the scanning line driving circuit 4 changes the voltage level of the scanning line 17B from HIGH to LOW to bring the switching transistor 19A into an off state (Step S43 in FIG. 13). At this time, the electrostatic capacitor 41A stores the source potential of the driving transistor 14A even when the switching transistor 19A is brought into an off state. Thus, the voltage between the gate and source of the driving transistor 14A is stabilized. In other words, the signal current in the luminescence pixel 10A is stabilized irrespective of whether the switching transistor 19A is in an on state or in an off state.

In addition, at Time t32, the voltage level of the scanning line 17B changes from HIGH to LOW, thereby turning off the switching transistors 11B and 12B. This shuts off electricity between the electrode 131B of the electrostatic capacitor 13B and the reference power source line 20, and between the electrode 132B of the electrostatic capacitor 13B and the signal line 16 (Step S43 in FIG. 13).

In addition, at Time t32' later than Time t32 by a minute time, the scanning line driving circuit 4 changes the voltage level of the scanning line 17C from LOW to HIGH to turn on the switching transistor 19B. With this, the source of the driving transistor 14B and the electrode 132B of the electrostatic capacitor 13B become conductive (Step S43 in FIG. 13). In addition, the electrode 131B and the electrode 132B of the electrostatic capacitor 13B are cut off from the reference power source line 20 and the signal line 16, respectively. Thus, the gate voltage of the driving transistor MB changes, and a driving current corresponding to the voltage (VREF-$V_B$data) flows into the organic EL element 15B.

During the period from Time t32 to Time t33, a both-end voltage (VREF-$V_B$data) of the electrostatic capacitor 13B is being applied to between the gate and source of the driving transistor 14B in the luminescence pixel 10B, and a flow of a driving current enables the organic EL element 15B to keep emitting light.

Next, at Time t33, the scanning line driving circuit 4 changes the voltage level of the scanning line 17C from HIGH to LOW to bring the switching transistor 19B into an off state. At this time, the electrostatic capacitor 41B stores the source potential of the driving transistor 14B even when the switching transistor 19B is brought into an off state. Thus, the voltage between the gate and source of the driving transistor 14B is stabilized. In other words, the signal current in the luminescence pixel 10B is stabilized irrespective of whether the switching transistor 19B is in an on state or in an off state.

Sequentially performing the aforementioned operations in t30 to t33 on the luminescence pixels positioned downstream in the same column makes it possible to enable the pixels to emit light with a constant delay time determined on a line-by-line basis.

As described above, disposing the electrostatic capacitor 41 that is the second capacitor in the luminescence pixel 10 enables a light emission which is constant irrespective of whether the switching transistor 19 is in an on state or in an off state. This makes it possible to use a common scanning line for luminescence pixels adjacent to each other in a pixel column. This enables reduction in the number of scanning lines for controlling switching transistors, and therefore it is possible to simplify the circuit configuration of the image display device. Further, it is possible to simplify the driving circuits for outputting the scanning signals.

As described above, configuring a simple pixel circuitry as in each of Embodiments 1 to 3 makes it possible to store the accurate potential corresponding to a signal voltage into both end electrodes of a capacitor which holds a voltage to be applied to between the gate and source of an n-type driving TFT which performs a source grounding operation. This makes it possible to achieve an accurate image display reflecting a video signal. Further, disposing the second capacitor which stores the source potential of the n-type driving TFT stabilizes the voltage between the gate and source of the n-type driving TFT, thereby stabilizing the driving current, that is, achieving a stable light emitting operation.

It is to be noted that the image display devices according to the present invention is not limited to those in the above-described embodiments. The present invention should be appreciated as including other embodiments implemented by combining arbitrary structural elements in Embodiments 1 to 3 and their Variations, variations that a person skilled in the art would arrive at by modifying Embodiments 1 to 3 and their Variations within the scope of the present invention, and various devices in which a display device according to the present invention is embedded.

Figure 14:
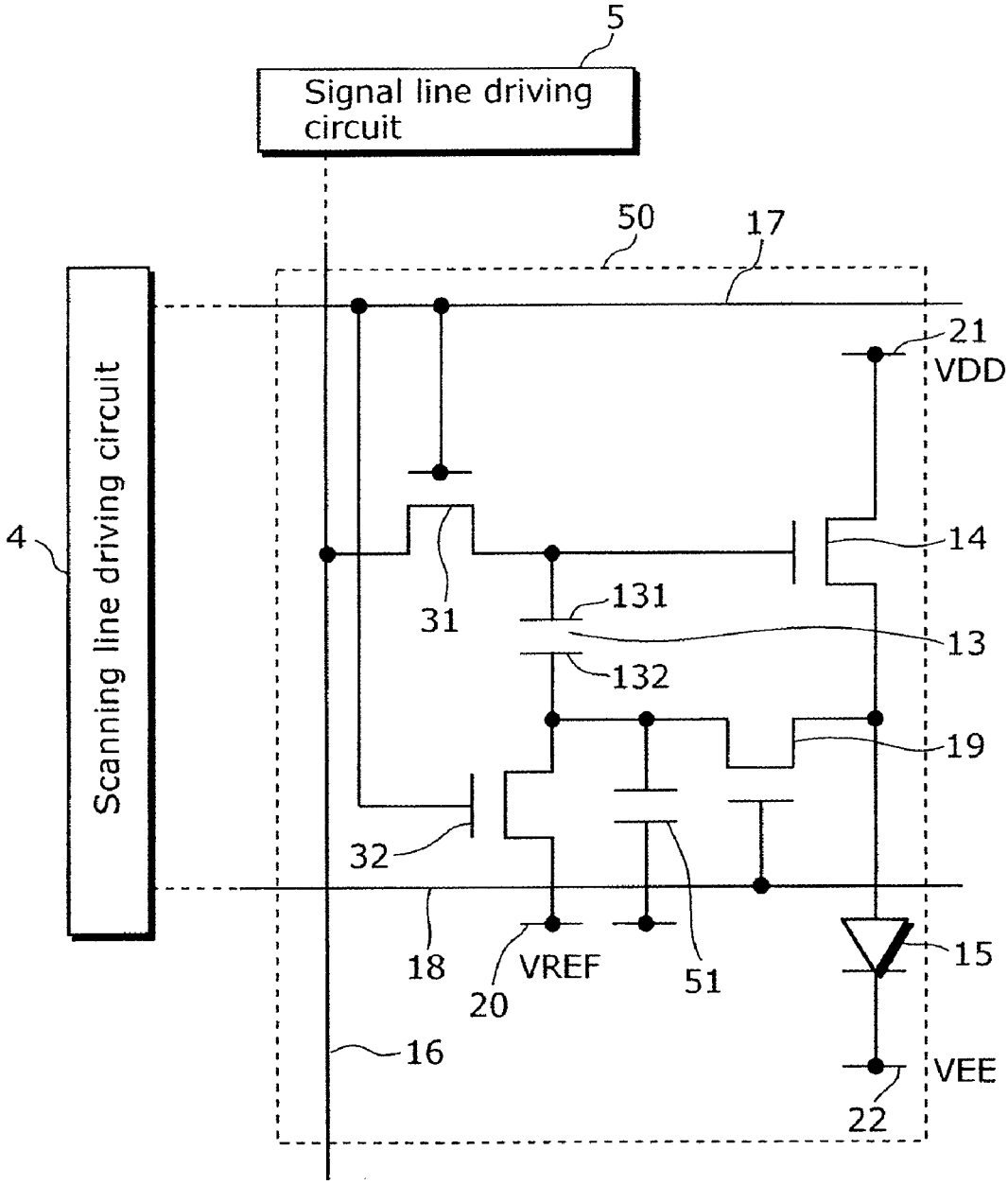
FIG. 14 is a diagram showing a circuit configuration of a luminescence pixel and connections with the surrounding circuits which are obtained by combining Embodiments 2 and 3 of the present invention.

For example, a pixel circuitry obtained by combining Embodiment 2 and Embodiment 3 is included in the present invention. FIG. 14 is a diagram showing a circuit configuration of a luminescence pixel and connections with the surrounding circuits which are obtained by combining Embodiments 2 and 3 of the present invention. The luminescence pixel 50 shown in the diagram includes switching transistors 19, 31, and 32, electrostatic capacitors 13 and 51, a driving transistor 14, an organic EL element 15, a signal line 16, scanning lines 17 and 18, a reference power source line 20, a positive power source line 21, and a negative power source line 22. In addition, the surrounding circuits include a scanning line driving circuit 4 and a signal line driving circuit 5.

The luminescence pixel 50 is structurally different from the luminescence pixel 40 according to Embodiment 3 shown in FIG. 8 only in the connection of the switching transistor to the both end electrodes of the electrostatic capacitor 13.

The electrostatic capacitor 51 is a second capacitor connected between the electrode 132 of the electrostatic capacitor 13 and the reference power source line 20, and has a function of stabilizing the voltage between the gate and source of the driving transistor 14 likewise the electrostatic capacitor 41 included in the luminescence pixel 40 of Embodiment 3.

Thus, it is possible to use a scanning line for adjacent luminescence pixels as in FIG. 11 also in the display unit including a circuit configuration of the luminescence pixel 50. Accordingly, as in Embodiment 3, it is possible to reduce the number of scanning lines for controlling switching transistors, thereby being able to simplify the circuit configuration of the image display device.

It is to be noted that the electrostatic capacitor 51 may be connected to a reference power source line other than the reference power source line 20 connected to one of the source and drain of the switching transistor 32. For example, the electrostatic capacitor 41 may be a positive power source line VDD or a negative power source line VEE. In this case, the layout flexibility increases, and thus a wide space is secured between elements, thereby achieving an increased yield.

Throughout Embodiments 1 to 3, the switching transistors 12 and 32 (first switching elements) and the switching transistors 11 and 31 (second switching elements) are controlled in a same manner using the same scanning line 17. However, it is to be noted that the first switching elements and the second switching elements may be independently turned on or off using different scanning lines (a first scanning line and a second scanning line). In this case, the timing at which a signal voltage is applied from the signal line 16 to the electrostatic capacitor 13 is controlled independently of the timing at which a reference voltage is applied from the reference power source line 20 to the electrostatic capacitor 13. With this, it is also possible to execute duty control for light emission in a frame.

The above embodiments have been described as n-type transistors which are brought into an on state when the voltage level of the switching transistor is HIGH. However, it is to be noted that image display devices which is configured to include p-type transistors instead of these n-type transistors and have a reversed polarity in the scanning lines provide the same advantageous effects as in those provided by the respective embodiments.

Further, the above embodiments have been described assuming that the switching transistors are FETs having a gate, a source, and a drain. However, these switching transistors may be bipolar transistors having a base, a collector, and an emitter. In this case, the object of the present invention is achieved, and the same advantageous effects are provided.

Figure 15:
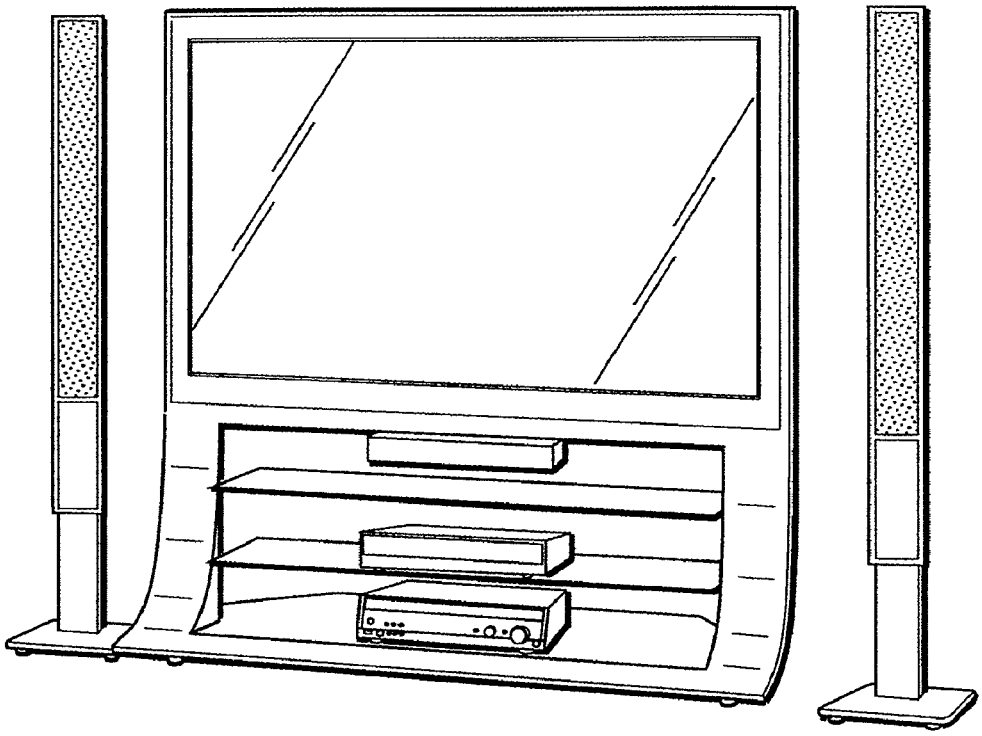
FIG. 15 is an external view of a thin flat TV including an embedded image display device according to an embodiment of the present invention.
Figure 16:
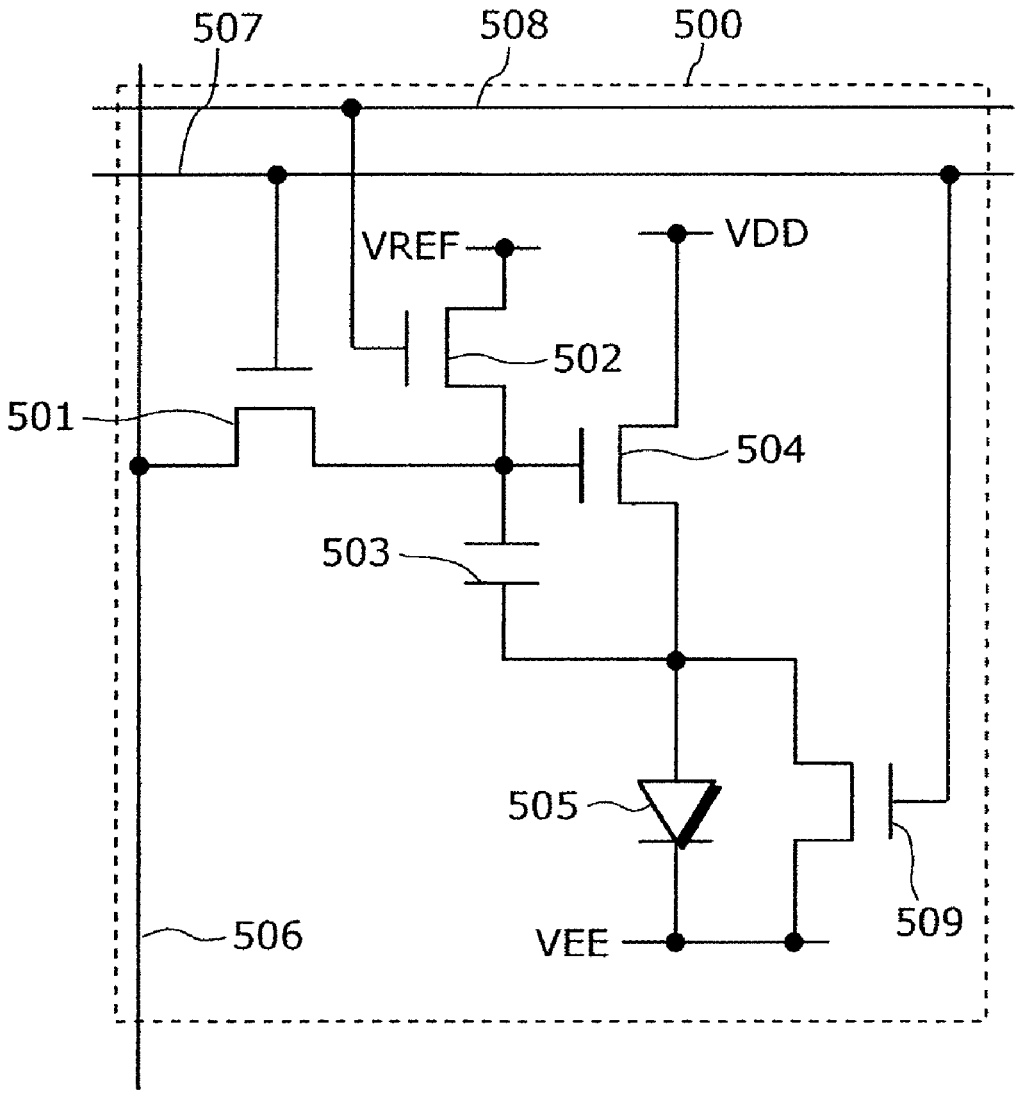
FIG. 16 is a diagram showing a circuit configuration of a pixel unit in the conventional organic EL display device disclosed in Patent Reference.

In addition, a display device according to the present invention is embedded, for example, in a thin flat TV as shown in FIG. 15. Embedding an image display device according to the present invention makes it possible to achieve a thin flat TV capable of achieving accurate image display reflecting a video signal.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The present invention is particularly applicable to active-type organic EL flat panel displays which fluctuate luminance by controlling the luminance intensity of pixels using pixel signal currents.

What is claimed is:

1. A method of controlling an image display device, the image display device including:

a luminescence element that has a first electrode and a second electrode;

a first capacitor that has a first electrode and a second electrode, and holds a capacitor voltage;

a driver that has a drain electrode, a gate electrode connected to the first electrode of the first capacitor, and a source electrode connected to the first electrode of the luminescence element, and causes the luminescence element to emit light by applying a drain current corresponding to the capacitor voltage held by the first capacitor to the luminescence element;

a second capacitor that has a first electrode connected to the second electrode of the first capacitor and a second electrode;

a first power source line for determining a potential of the drain electrode of the driver;

a second power source line electrically connected to the second electrode of the luminescence element;

a third power source line for supplying a first reference voltage to the first electrode of the first capacitor;

a fourth power source line for supplying a second reference voltage to the second electrode of the second capacitor;

a data line for supplying a signal voltage to the second electrode of the first capacitor;

a first switch between the third power source line and the first electrode of the first capacitor for supplying the first reference voltage to the first electrode of the first capacitor;

a second switch between the data line and the second electrode of the first capacitor for supplying the signal voltage to the second electrode of the first capacitor; and a third switch between the first electrode of the luminescence element and the second electrode of the first capacitor for connecting the first electrode of the luminescence element and the second electrode of the first capacitor, said method comprising:

causing the first capacitor to hold the capacitor voltage corresponding to the signal voltage by switching ON the first switch and the second switch while the third switch is switched OFF;

switching OFF the first switch and the second switch to turn ON the third switch after the capacitor voltage corresponding to the signal voltage is held by the first capacitor; and causing the second capacitor to hold a source potential of the driver while the third switch is switched ON.

2. The method of controlling the image display device according to claim 1, wherein the first electrode of the luminescence element is an anode electrode, the second electrode of the luminescence element is a cathode electrode, a voltage of the first power source line is greater than a voltage of the second power source line, and a current flows from the first power source line to the second power source line.

3. The method of controlling the image display device according to claim 1, the image display device including:

a first scanning line that connects the first switch and the controller for transmitting a signal to the first switch for controlling the first switch;

a second scanning line that connects the second switch and the controller for transmitting a signal to the second switch for controlling the second switch; and a third scanning line that connects the third switch and the controller for transmitting a signal to the third switch for controlling the third switch.

4. The method of controlling the image display device according to claim 3, wherein the first scanning line and the second scanning line are a common scanning line.

5. The method of controlling the image display device according to claim 1, wherein the third power source line and the fourth power source line are a common power source line.

6. The method of controlling the image display device according to claim 1, wherein the third power source line is separate from the fourth power source line.

7. The method of controlling the image display device according to claim 1, wherein the luminescence element is an organic electro-luminescence element.

8. A method of controlling an image display device, the image display device including:

a luminescence element that has a first electrode and a second electrode;

a first capacitor that has a first electrode and a second electrode, and holds a capacitor voltage;

a driver that has a drain electrode, a gate electrode connected to the first electrode of the first capacitor, and a source electrode connected to the first electrode of the luminescence element, and causes the luminescence element to emit light by applying a drain current corresponding to the capacitor voltage held by the first capacitor to the luminescence element;

a second capacitor that has a first electrode connected to the second electrode of the first capacitor and a second electrode;

a first power source line for determining a potential of the drain electrode of the driver;

a second power source line electrically connected to the second electrode of the luminescence element;

a third power source line for supplying a first reference voltage to the second electrode of the first capacitor;

a fourth power source line for supplying a second reference voltage to the second electrode of the second capacitor;

a data line for supplying a signal voltage to the first electrode of the first capacitor;

a first switch between the third power source line and the second electrode of the first capacitor for supplying the first reference voltage to the second electrode of the first capacitor;

a second switch between the data line and the first electrode of the first capacitor for supplying the signal voltage to the first electrode of the first capacitor; and a third switch between the first electrode of the luminescence element and the second electrode of the first capacitor for connecting the first electrode of the luminescence element and the second electrode of the first capacitor, said method comprising:

causing the first capacitor to hold the capacitor voltage corresponding to the signal voltage by switching ON the first switch and the second switch while the third switch is switched OFF;

switching OFF the first switch and the second switch to turn ON the third switch after the capacitor voltage corresponding to the signal voltage is held by the first capacitor; and causing the second capacitor to hold a source potential of the driver while the third switch is switched ON.

9. The method of controlling the image display device according to claim 8, wherein the first electrode of the luminescence element is an anode electrode, the second electrode of the luminescence element is a cathode electrode, a voltage of the first power source line is greater than a voltage of the second power source line, and a current flows from the first power source line to the second power source line.

10. The method of controlling the image display device according to claim 8, the image display device including:

a first scanning line that connects the first switch and the controller for transmitting a signal to the first switch for controlling the first switch;

a second scanning line that connects the second switch and the controller for transmitting a signal to the second switch for controlling the second switch; and a third scanning line that connects the third switch and the controller for transmitting a signal to the third switch for controlling the third switch.

11. The method of controlling the image display device according to claim 10, wherein the first scanning line and the second scanning line are a common scanning line.

12. The method of controlling the image display device according to claim 8, wherein the third power source line and the fourth power source line are a common power source line.

13. The method of controlling the display device according to claim 8, wherein the third power source line is separate from the fourth power source line.

14. The method of controlling the image display device according to claim 8, wherein the luminescence element is an organic electro-luminescence element.

* * * * *